US008952816B2

(12) United States Patent
Sayegh et al.

(10) Patent No.: US 8,952,816 B2
(45) Date of Patent: Feb. 10, 2015

(54) ARTICLE SURVEILLANCE TAG WITH MULTIPLE STRAPS

(75) Inventors: Adel O. Sayegh, Rancho Cucamonga, CA (US); Edgardo Redublo, Chino Hills, CA (US); Weiliang Tong, Hangzhou (CN); Mingxing Chen, Hangzhou (CN)

(73) Assignee: USS Technologies, LLC, Rancho Cucamonga, CA (US)

( * ) Notice: Subject to any disclaimer, the term of this patent is extended or adjusted under 35 U.S.C. 154(b) by 1035 days.

(21) Appl. No.: 12/876,043

(22) Filed: Sep. 3, 2010

(65) Prior Publication Data

US 2011/0140895 A1 Jun. 16, 2011

Related U.S. Application Data

(60) Provisional application No. 61/239,779, filed on Sep. 3, 2009.

(51) Int. Cl.

| | |
|---|---|
| ***G08B 13/14*** | (2006.01) |
| ***E05B 73/00*** | (2006.01) |
| *E05B 45/00* | (2006.01) |

(52) U.S. Cl.

CPC ..... *E05B 73/0017* (2013.01); *E05B 45/005* (2013.01)

USPC ..... 340/572.8; 70/57.1; 340/572.9

(58) Field of Classification Search

USPC ..... 340/572.8, 572.9; 70/57.1

See application file for complete search history.

(56) References Cited

U.S. PATENT DOCUMENTS

| | | | | |
|---|---|---|---|---|
| 5,969,613 | A * | 10/1999 | Yeager et al. | 340/572.9 |
| 6,144,301 | A * | 11/2000 | Frieden | 340/572.8 |
| 7,412,857 | B2 * | 8/2008 | Kolton et al. | 340/572.9 |
| 2007/0012772 | A1 * | 1/2007 | Cooper | 340/572.8 |
| 2010/0315237 | A1 * | 12/2010 | Yang | 340/572.8 |

* cited by examiner

*Primary Examiner* — Thomas Mullen

(74) *Attorney, Agent, or Firm* — Milord A. Keshishian

(57) ABSTRACT

An EAS system alarm tag is provided with two or more straps that enable secure and reliable simultaneous engagement of the tag with one or more articles that are detachably coupled at an angle. An interlock actuator switch enables the two or more straps to interlock within a housing of the alarm tag. An auxiliary actuator switch enables detection of separation of the alarm tag from one or more articles with which the alarm tag is coupled. When both the interlock actuator switch and the auxiliary actuator switch are set to a first condition, an alarm system of the alarm tag is armed and set to ON; and when the interlock actuator switch is set to the first condition and the auxiliary actuator switch is set to a second condition while the alarm tag is armed and ON, the alarm system of the alarm tag triggers an alarm.

19 Claims, 21 Drawing Sheets

ARTICLE SURVEILLANCE TAG WITH MULTIPLE STRAPS

CROSS-REFERENCE TO RELATED APPLICATIONS

This application claims the benefit of priority of the U.S. Utility Provisional Patent Application No. 61/239,779, filed Sep. 3, 2009, the entire disclosure of which is expressly incorporated by reference herein.

INCORPORATION BY REFERENCE

All publications and patent applications mentioned in this specification are herein incorporated by reference to the same extent as if each individual publication or patent application was specifically and individually indicated to be incorporated by reference.

BACKGROUND OF THE INVENTION

1. Field of the Invention

This invention relates to article surveillance tags and, more particularly, to an electronic article surveillance (EAS) system alarm tag using multiple straps.

2. Description of Related Art

Conventional EAS tags that use a single strap are well known and have been in use for a number of years. Regrettably, most conventional EAS tags with a single, semi-rigid strap suffer from obvious disadvantages in that they generally can secure only a single article, and depending on the shape or form-factor of the article, the semi-rigid formed loop of the strap around the article can easily be manipulated to be slipped off of the article.

Accordingly, in light of the current state of the art and the drawbacks to current alarm tags mentioned above, there remains a long standing and continuing need for an advance in the art of EAS and theft deterrent tags that makes the tags more difficult to defeat while providing a secure and reliable simultaneous engagement of one or more articles to be monitored.

BRIEF SUMMARY OF THE INVENTION

An exemplary aspect of the present invention provides an EAS system alarm tag with two or more straps that enable secure and reliable simultaneous engagement of the tag with one or more articles that are detachably coupled at an angle. An interlock actuator switch enables the two or more straps to interlock within a housing of the alarm tag. An auxiliary actuator switch enables detection of separation of the alarm tag from one or more articles with which the alarm tag is coupled. When both the interlock actuator switch and the auxiliary actuator switch are set to a first condition, an alarm system of the alarm tag is armed and set to ON; and when the interlock actuator switch is set to the first condition and the auxiliary actuator switch is set to a second condition while the alarm tag is armed and ON, the alarm system of the alarm tag triggers an alarm.

An exemplary optional aspect of the present invention provides an EAS alarm system tag, wherein:

the housing is comprised of:

a base having an exterior side that includes:

a set of interlock openings at a first lateral section of the base, along the longitudinal axis of the housing that receive a first, free distal end of a set of straps;

a set of hinge cavities at a second lateral section of the base along the longitudinal axis of the housing that accommodate a set of hinge mechanism coupled with a second distal end of the set of straps;

an auxiliary switch opening defined at a mid-section of the base along the longitudinal axis of the housing that accommodates the auxiliary actuator switch, with the mid-section of the base configured commensurate with a form-factor of a section of one or more articles with which the alarm tag couples.

Another exemplary optional aspect of the present invention provides an EAS alarm system tag, wherein:

the base has an interior side that includes:

a set of guide flanges that protrude from the interior side of the first lateral section of the base, along the longitudinal axis of the housing that facilitate to guide and move the first, free leading edge of the straps towards interlock actuator switch; and an auxiliary actuator witch housing that accommodates the auxiliary actuator switch and an auxiliary switch.

Still another exemplary optional aspect of the present invention provides an EAS alarm system tag, wherein:

the housing is comprised of:

a cover that includes:

a first aperture for accommodating the interlock actuator switch;

a second aperture for accommodating a visual indicator;

a protuberance for housing an interlock clutch; and perforated area that forms a grill-openings for output of an audio indicator sound.

A further exemplary optional aspect of the present invention provides an EAS alarm system tag, wherein:

a strap of one or more straps is comprised of:

the first, free leading edge;

the second distal end of the strap is accommodated within a set of hinge cavities at a second lateral section of the base along the longitudinal axis of the housing, and is coupled with a hinge mechanism in a form of a hinge pin;

the hinge pin is inserted within a hole of the second distal end of the strap, with the second distal end of the strap and the hinge pin secured within hinge chamber;

a first surface that includes engaging elements comprised of serrations that engage with an interlock clip of the interlock actuator switcher such that insertion of the strap into the housing in a first direction is allowed at any desired adjustments along a longitudinal axis of the strap, but extraction thereof is not allowed, thereby by enabling the EAS alarm tag to engage objects of varying sizes; and a tab that is projected from the first surface, oriented transverse a longitudinal axis of the strap.

Still a further exemplary optional aspect of the present invention provides an EAS alarm system tag, wherein:

the auxiliary actuator switch housing is coupled with the interior side of a mid-section of the base;

the auxiliary actuator switch housing is comprised of:

a set of fastening holes that enable use of a set of fasteners for coupling of the auxiliary actuator switch housing with the interior side of the base;

a first actuator opening that enables an actuator arm of the auxiliary actuator switch to move out of while pressing a switch arm of an auxiliary switch;

actuator guides that guide a set of support guides of the auxiliary actuator switch along a reciprocating path;

an auxiliary switch cover that encloses an auxiliary switch housing; and a pair of blocking flanges that secure auxiliary actuator switch.

Another exemplary optional aspect of the present invention provides an EAS alarm system tag, wherein:

the auxiliary actuator switch includes a biasing mechanism housing protruded from a mid-section of an interior bottom of the auxiliary actuator switch for accommodating a biasing mechanism;

support guides protruding from substantially distal portions of the interior bottom of the auxiliary actuator switch for facilitating move of the auxiliary actuator switch along the reciprocating path while the support guides move through actuator guides;

an actuator arm comprised of one or more curved sloping flanges that protrude from a periphery edge of the auxiliary actuator switch, along a length thereof, and spaced apart, enabling the actuator arm to slide over a switch arm of an auxiliary switch to ride and progressively actuate the auxiliary switch as the auxiliary actuator switch is fully pressed by an article.

Yet another exemplary optional aspect of the present invention provides an EAS alarm system tag, wherein:

the cover accommodates the interlock actuator switch and the alarm system of the alarm tag, the interlock actuator switch, comprising:

a clip at a top portion thereof;

an opening defined by walls for receiving a strap;

a locking protrusion associated with a locking clutch for locking the interlock actuator switching to a locked position; and an indentation for accommodating a switch arm of a switch;

wherein as the interlock actuator switch is moved from an unlock to a lock position, a lower beveled edge progressively presses the switch arm until a bottom edge reaches and fully presses the switch arm to activate the switch, with the interlock actuator switch locked in position by the associated locking clutch blocked by the locking protrusion.

Such stated advantages of the invention are only examples and should not be construed as limiting the present invention. These and other features, aspects, and advantages of the invention will be apparent to those skilled in the art from the following detailed description of preferred non-limiting exemplary embodiments, taken together with the drawings and the claims that follow.

BRIEF DESCRIPTION OF THE DRAWINGS

It is to be understood that the drawings are to be used for the purposes of exemplary illustration only and not as a definition of the limits of the invention. Throughout the disclosure, the word "exemplary" is used exclusively to mean "serving as an example, instance, or illustration." Any embodiment described as "exemplary" is not necessarily to be construed as preferred or advantageous over other embodiments.

Referring to the drawings in which like reference character (s) present corresponding part(s) throughout.

Figure 5A:
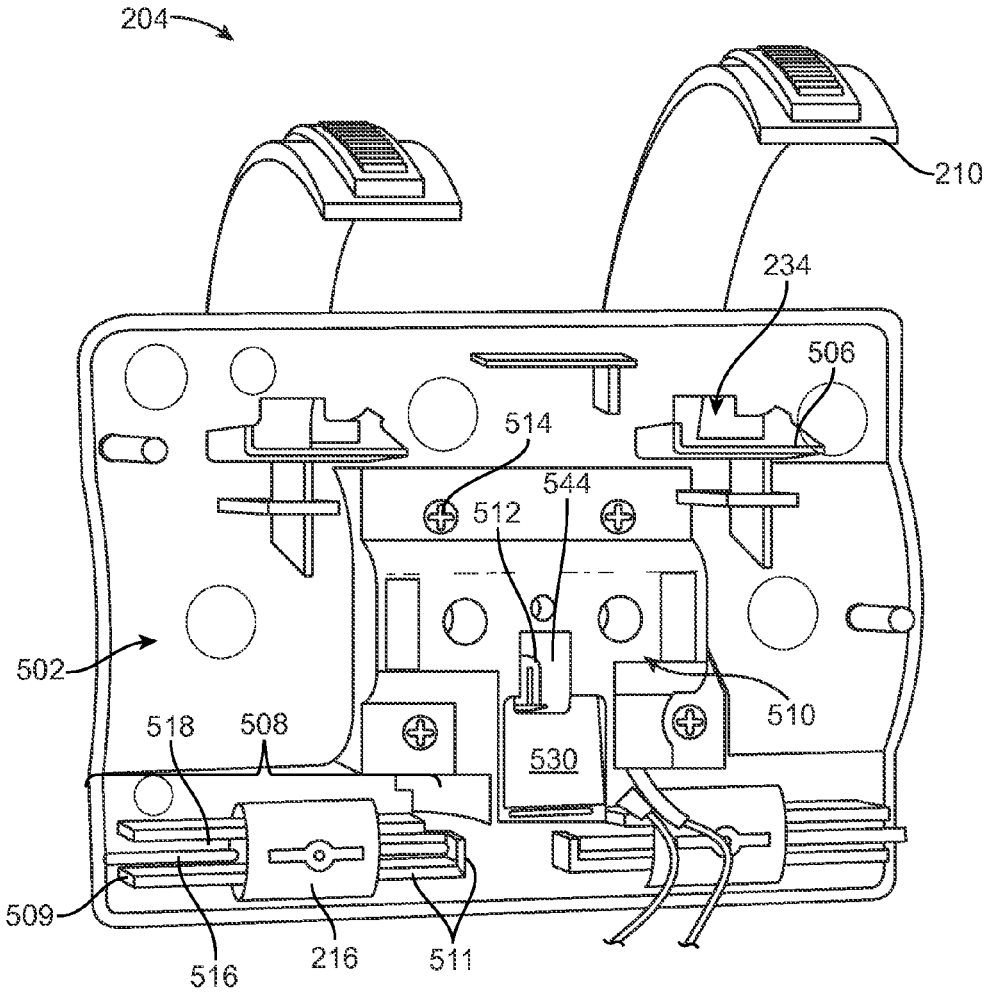
FIGS. 5A to 5L are exemplary illustrations of a base portion and components of a housing of the EAS system alarm tag shown in FIGS. 1A to 4 in accordance with the present invention.
Figure 5B:
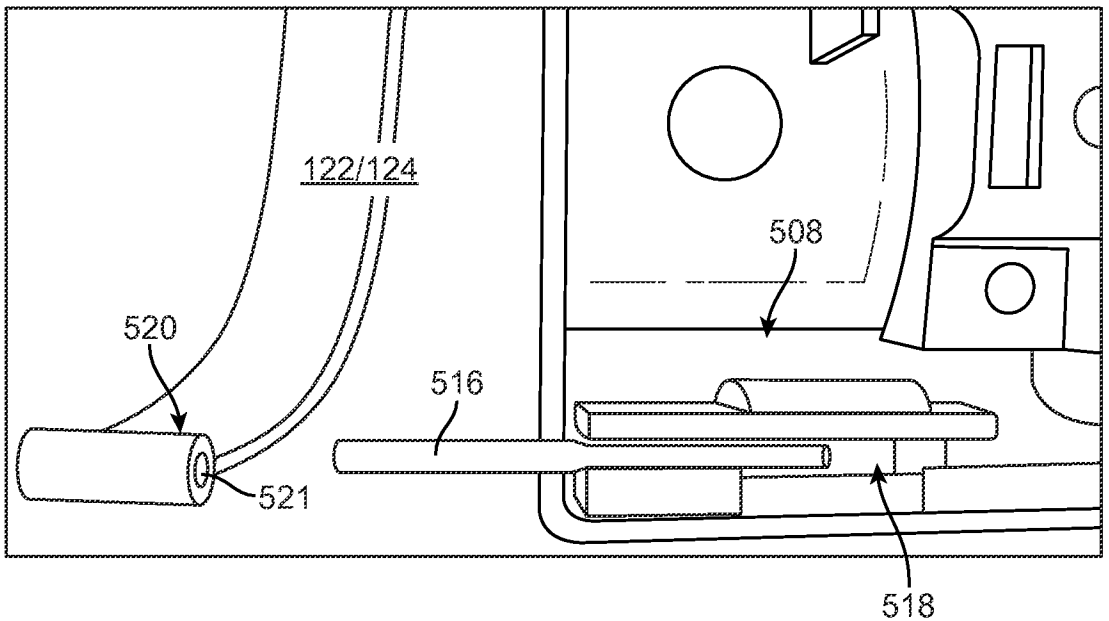
Figure 5C:
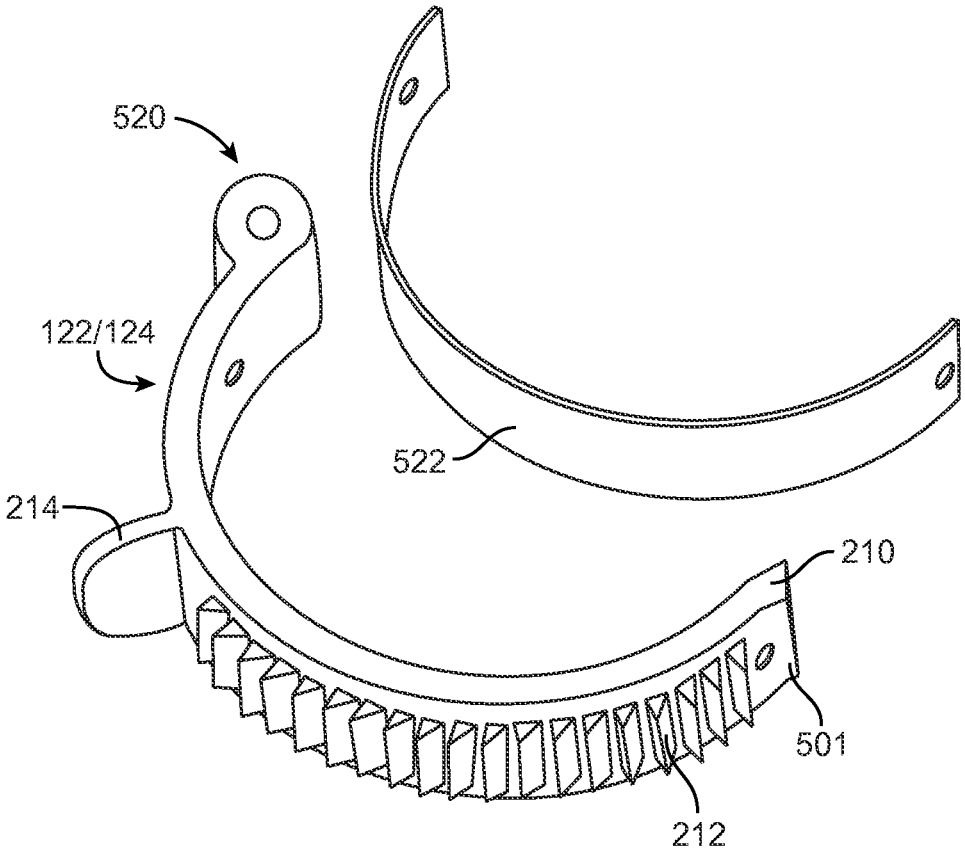
Figure 5D:
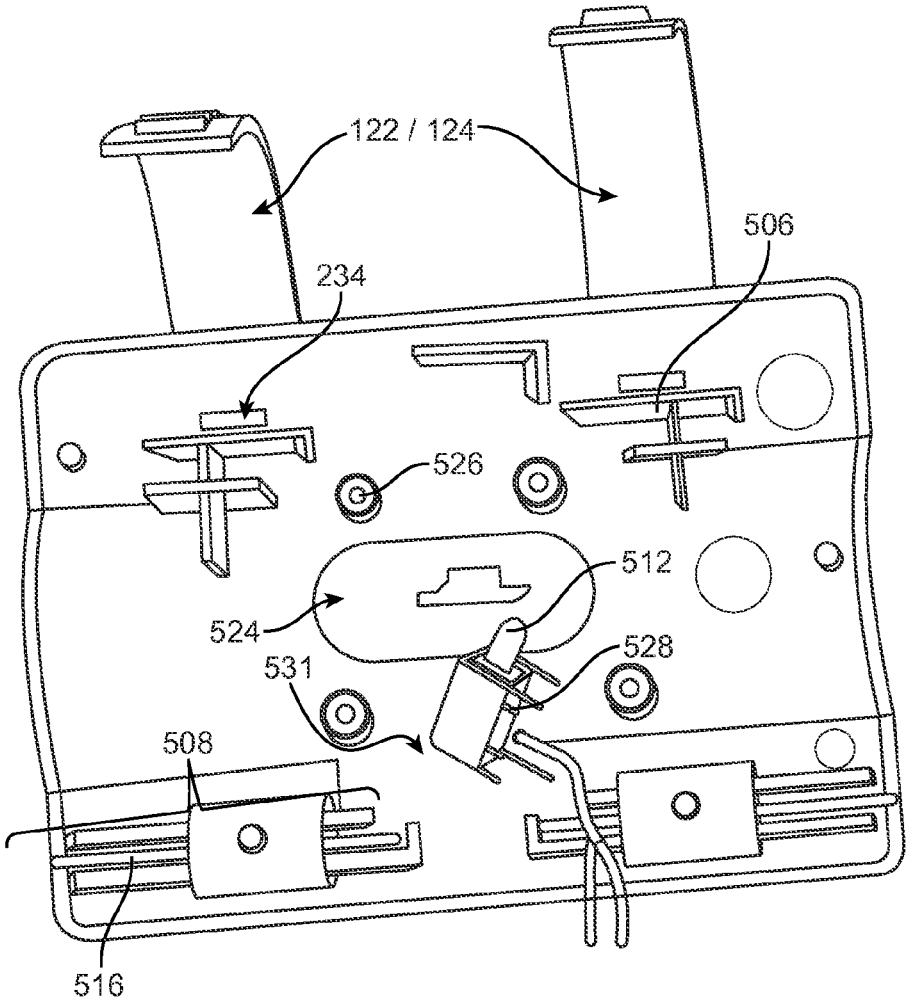
Figure 5F:
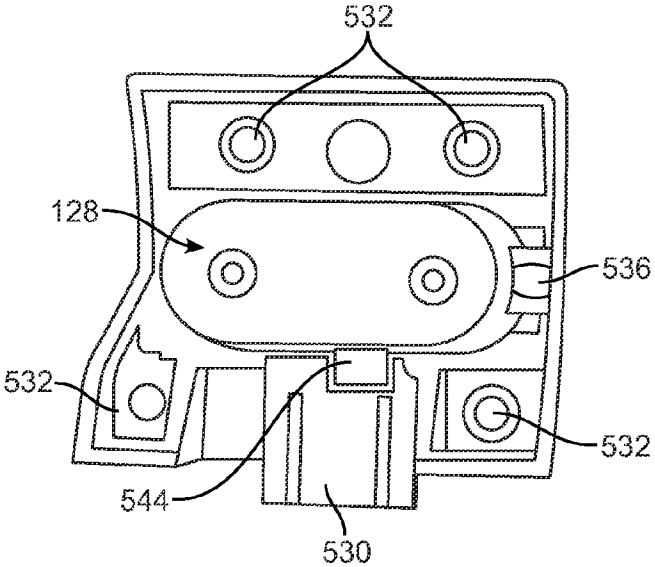
Figure 5E:
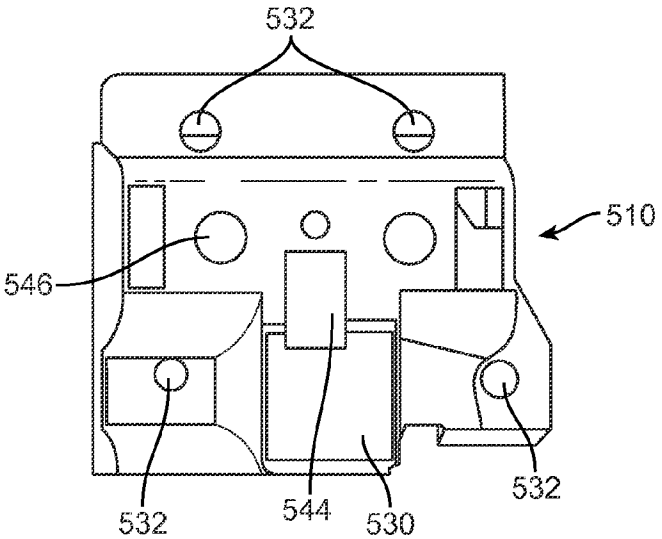
Figure 5G:
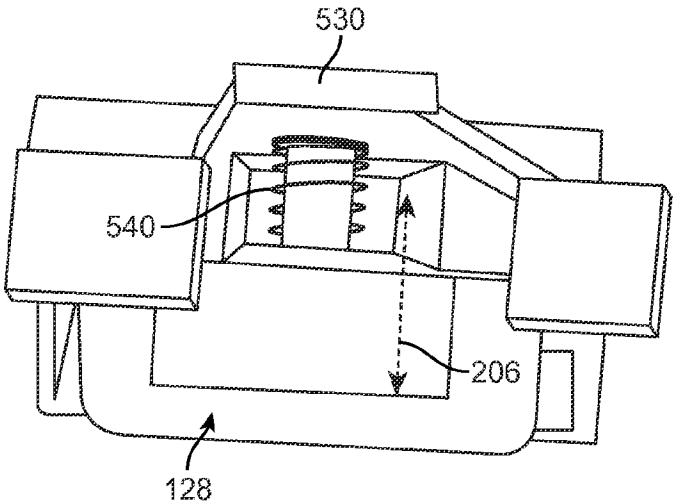
Figure 5I:
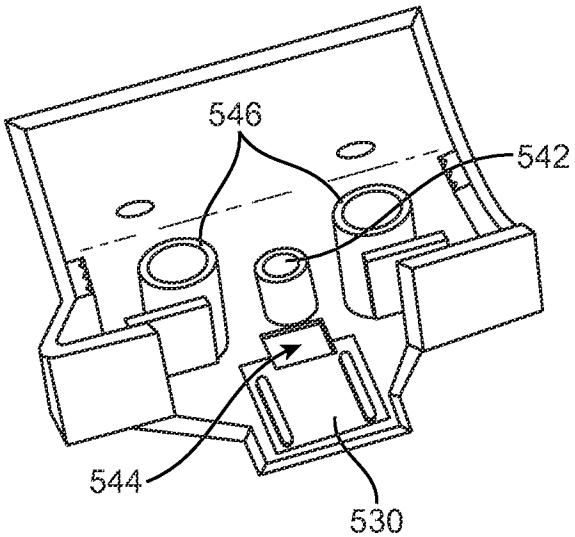
Figure 5H:
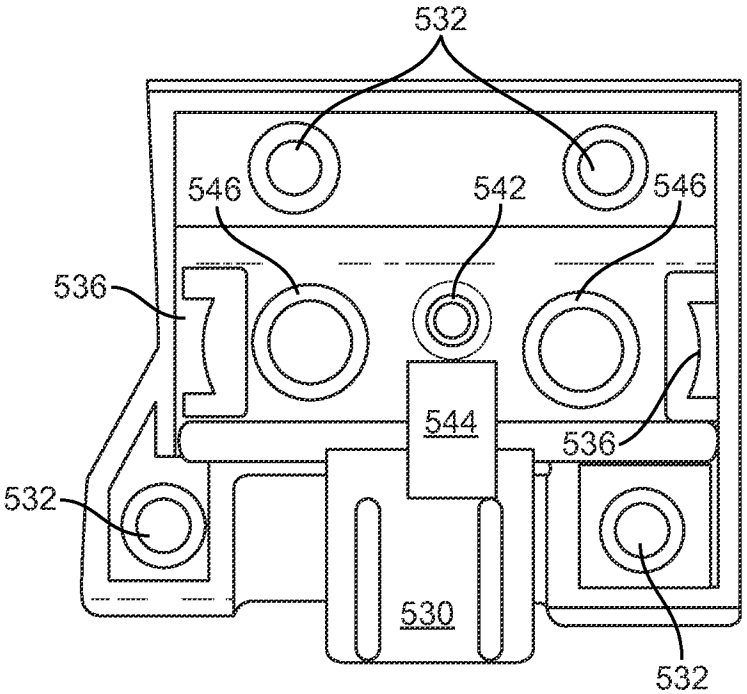
Figure 5J:
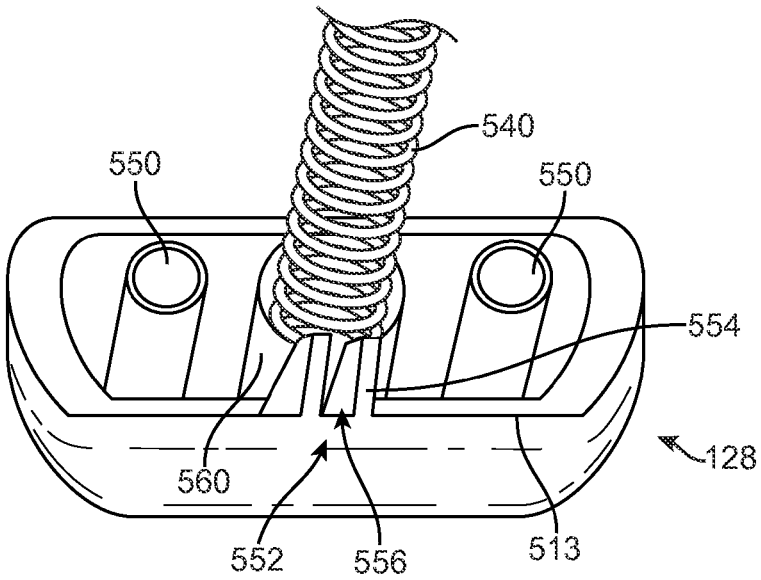
Figure 5K:
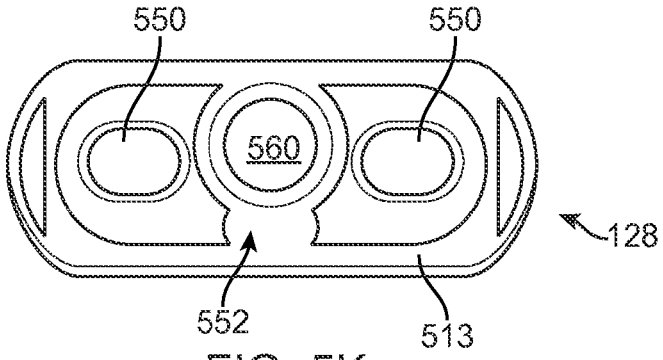
Figure 5L:
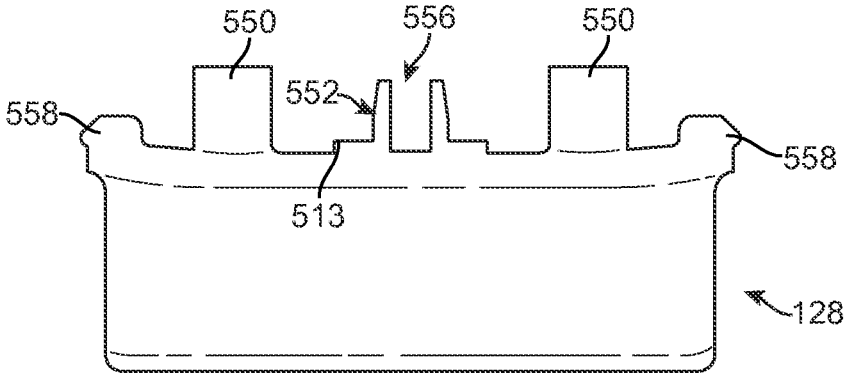
Figure 6A:
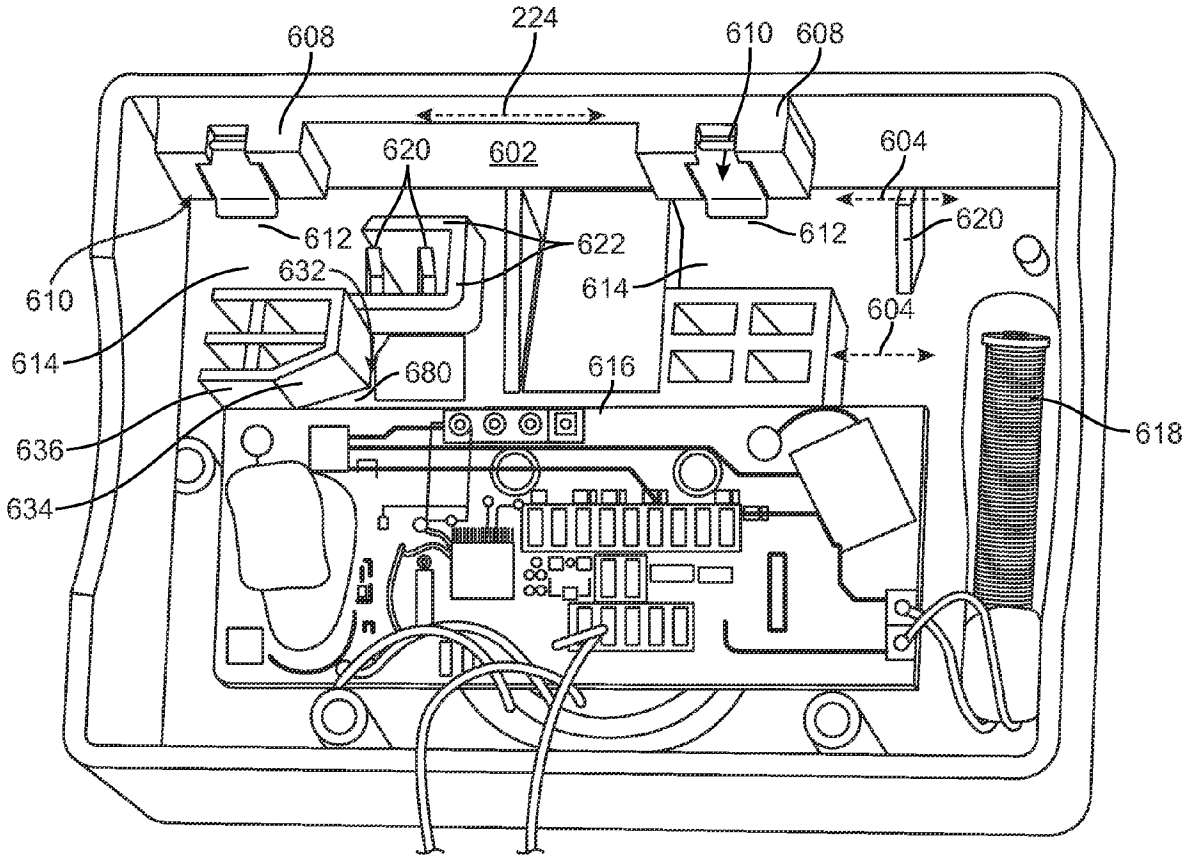
Figure 6B:
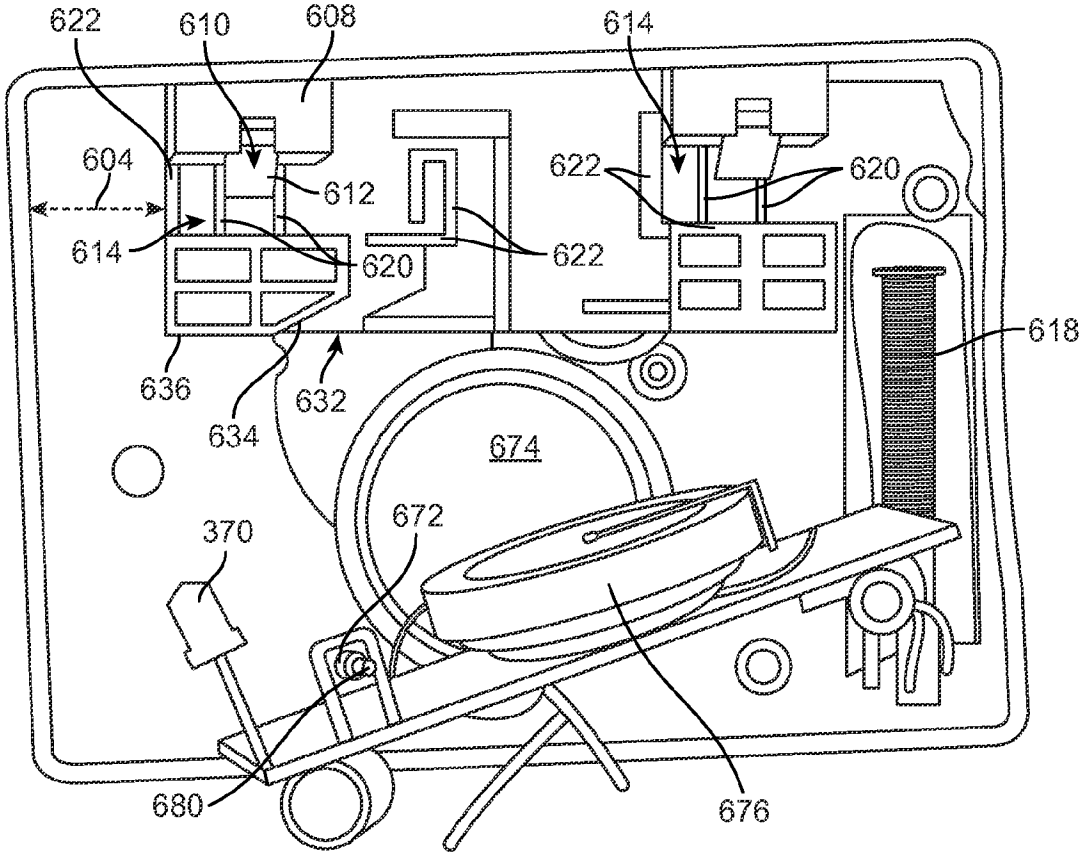
Figure 6C:
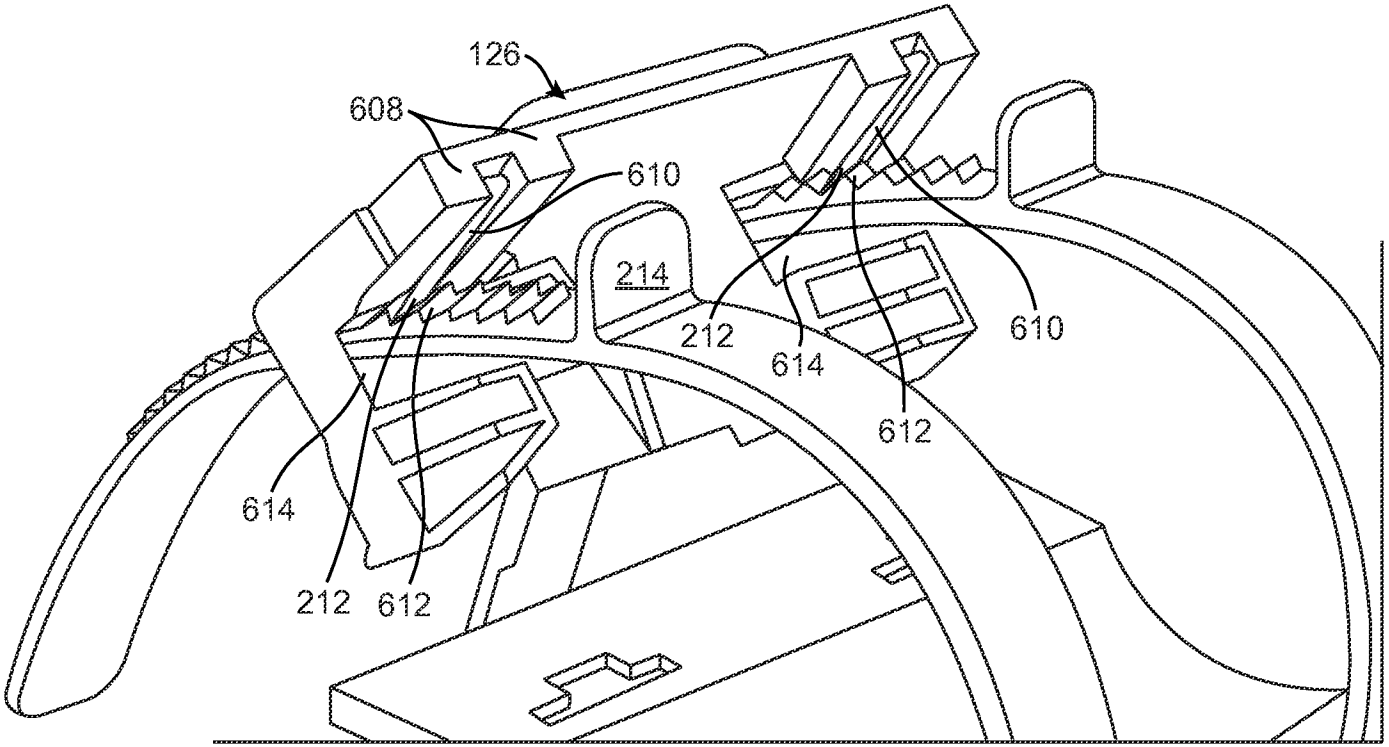
Figure 6D:
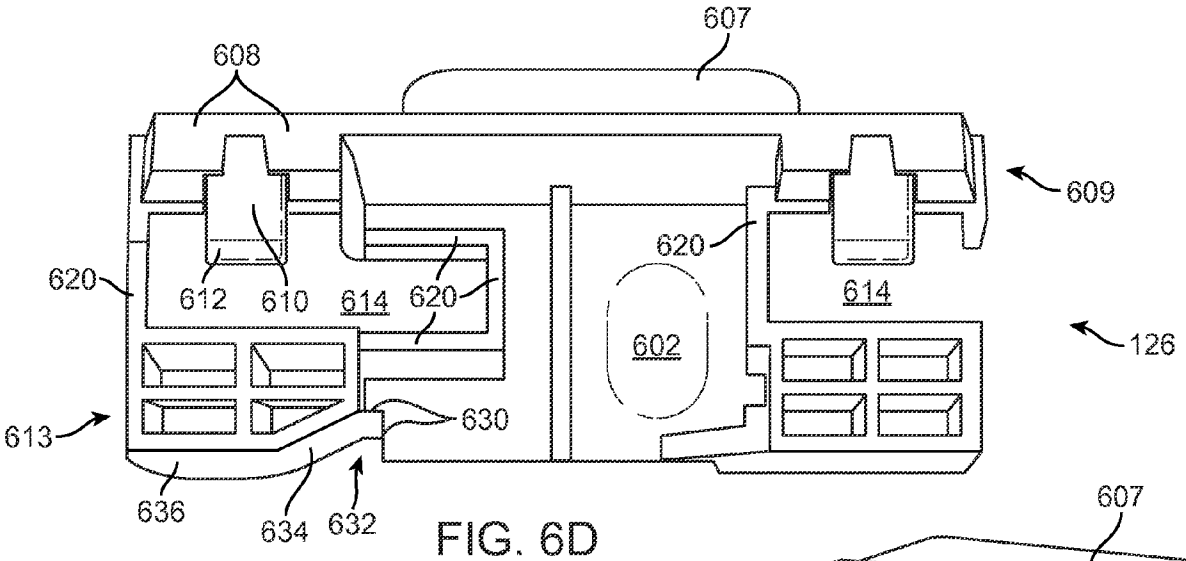
Figure 6E:
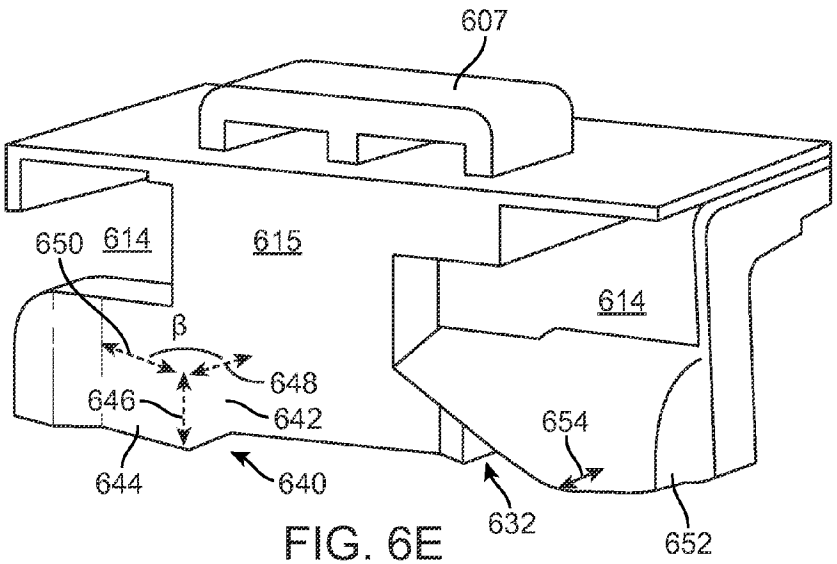
Figure 6F:
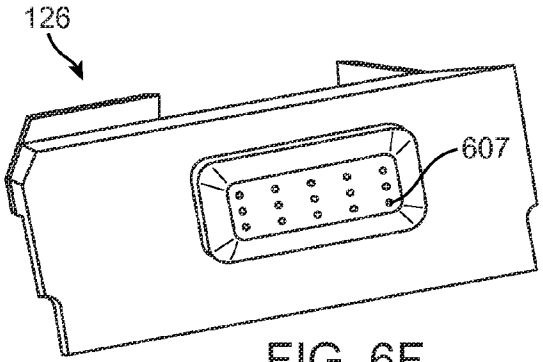
Figure 6G:
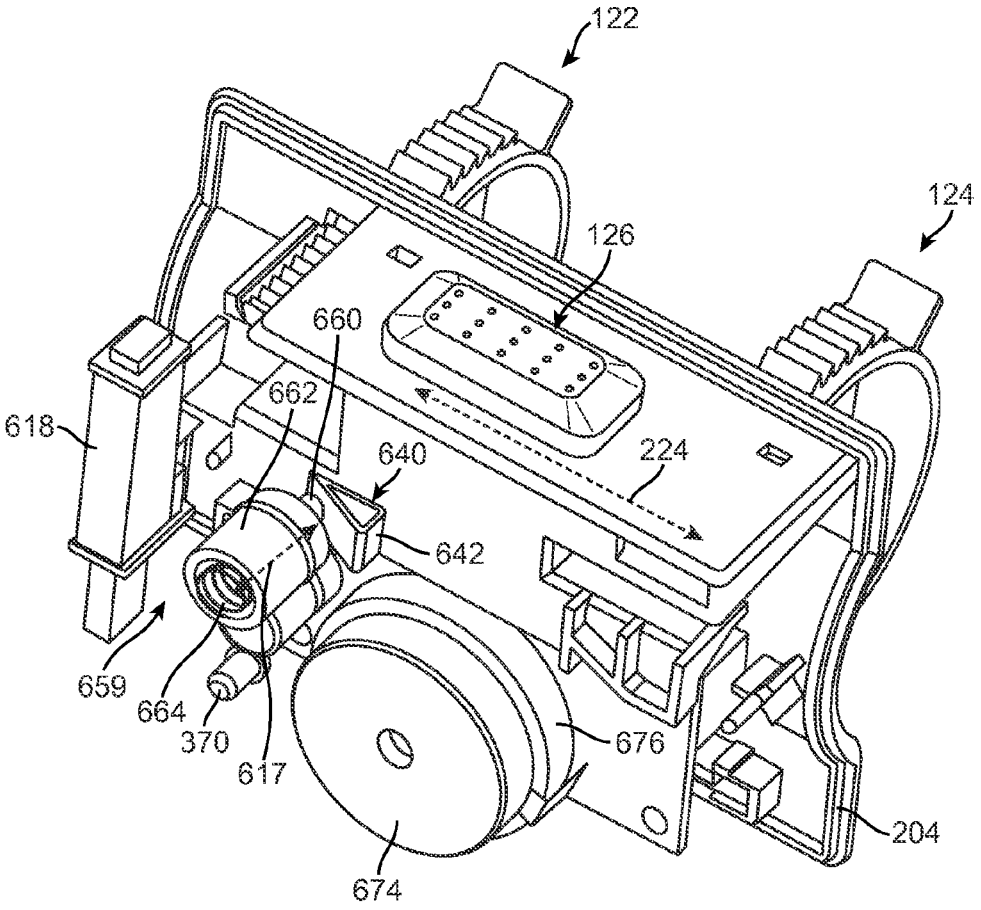
Figure 6H:
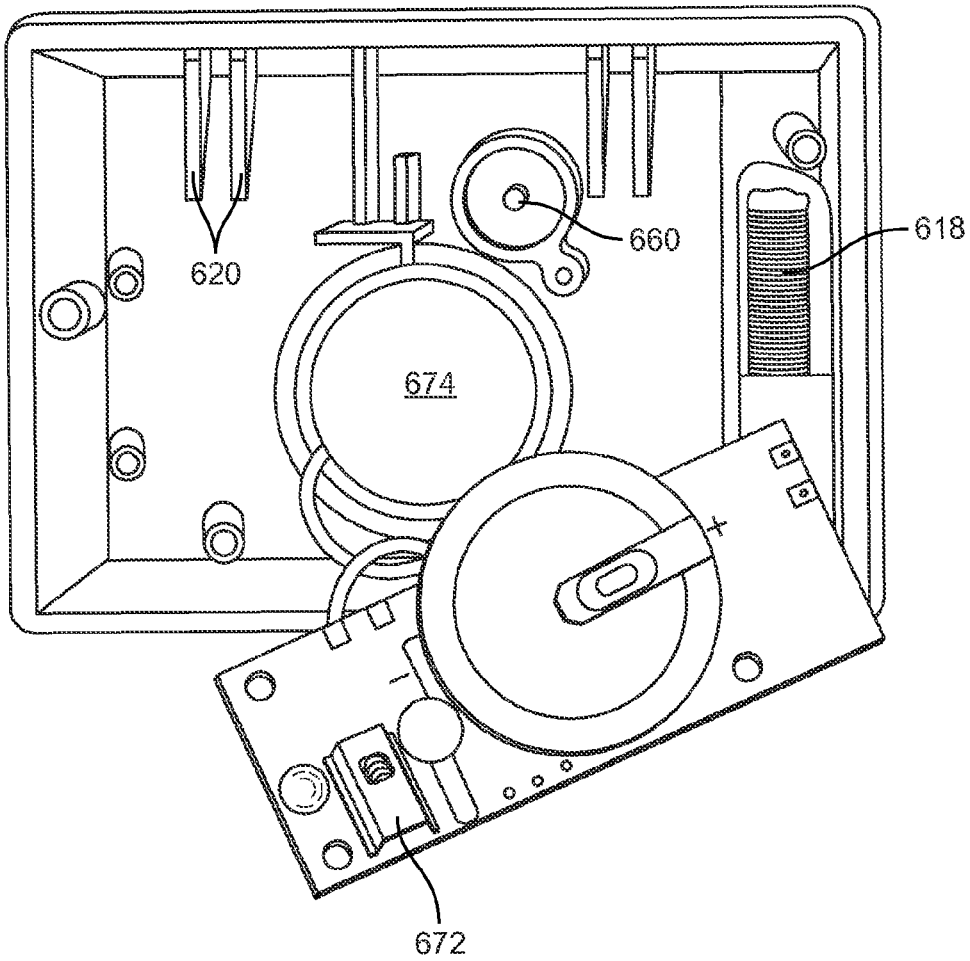
Figure 7:
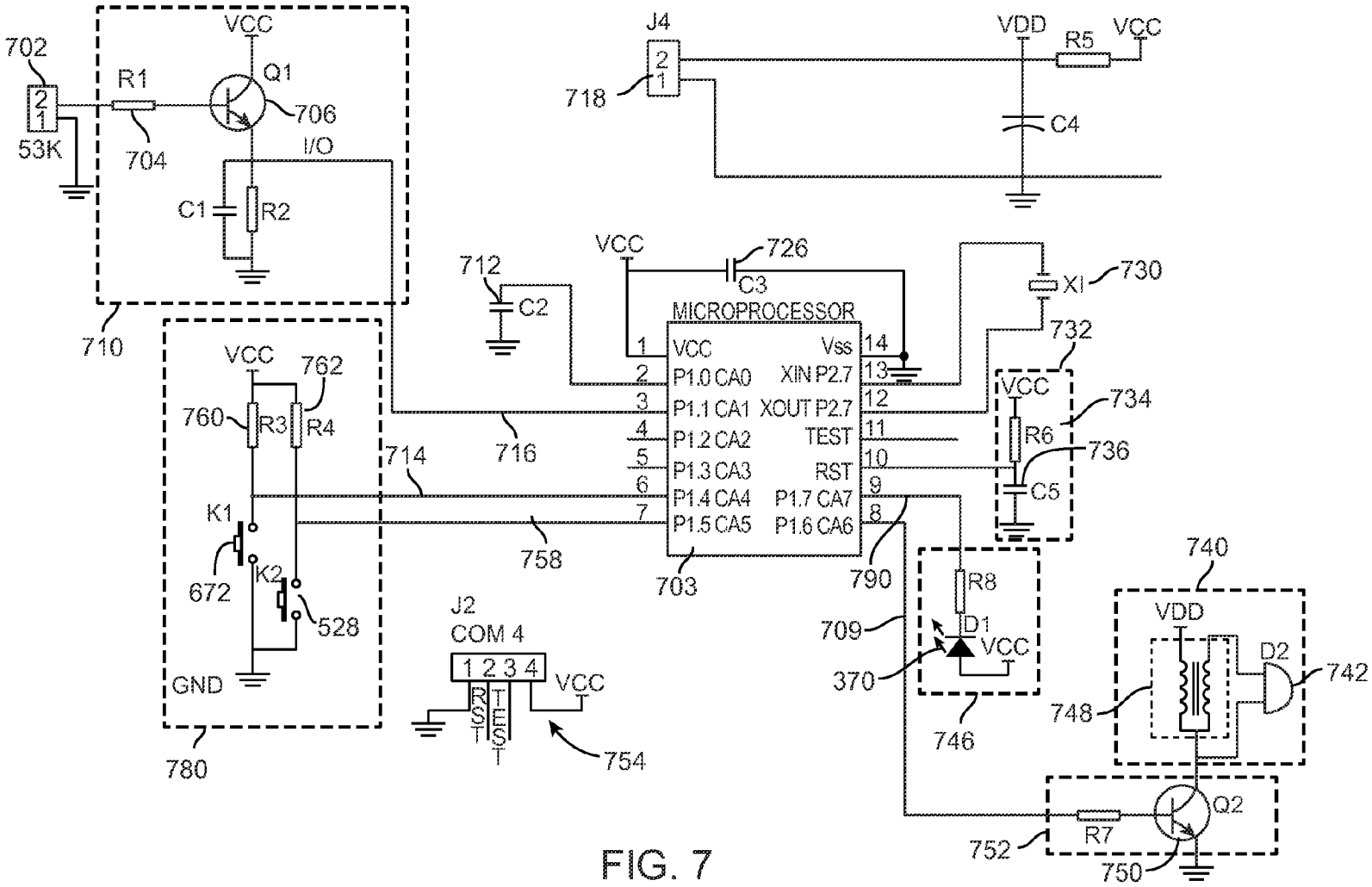
Figure 8:
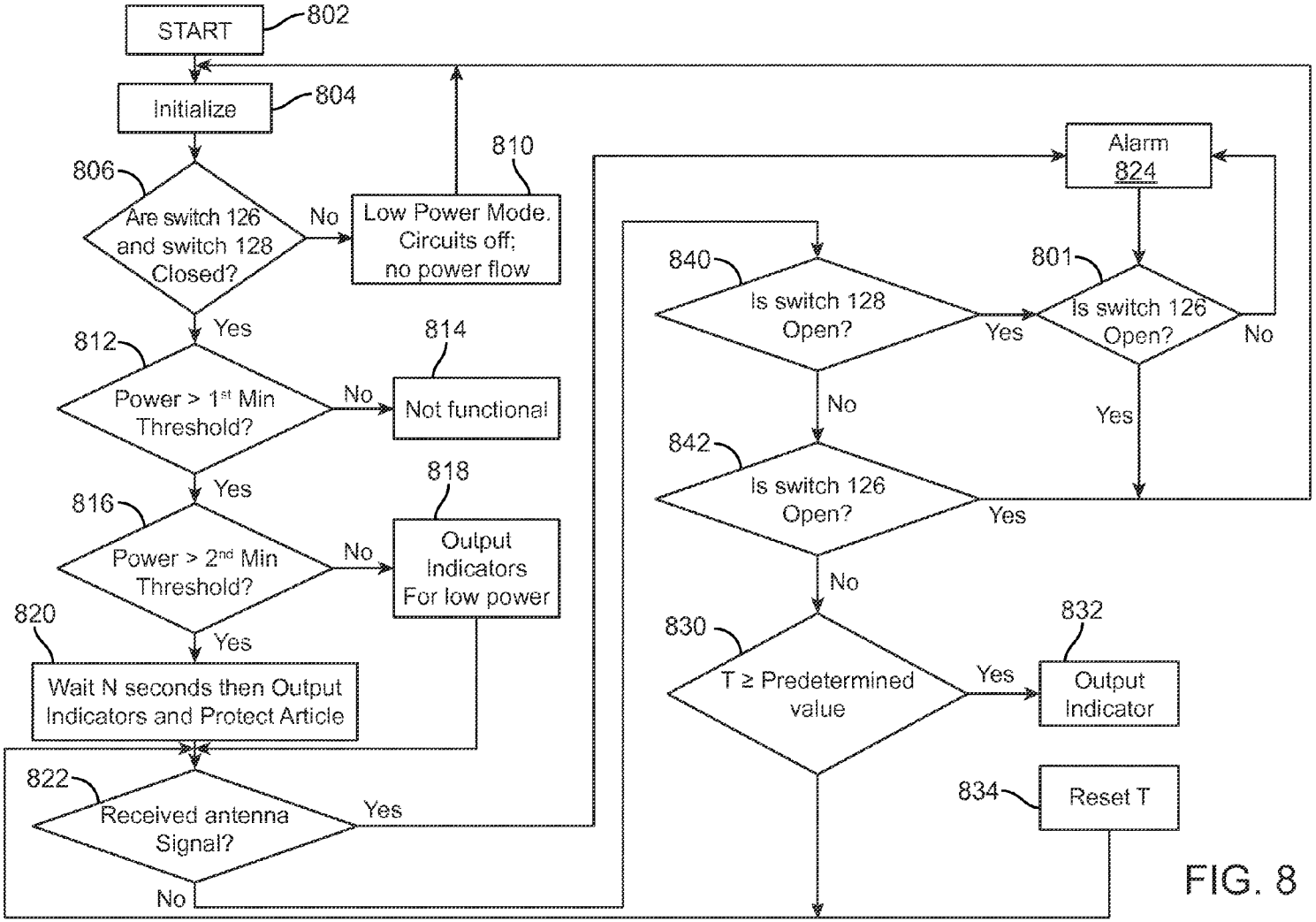

6A to 6H are exemplary illustrations of a cover portion and components therein of a housing of the EAS system alarm tag shown in FIGS. 1A to 5L in accordance with the present invention;

FIG. 7 is an exemplary schematic illustration of an alarm system of the EAS system alarm tag shown in FIGS. 1A to 6H in accordance with the present invention; and FIG. 8 is an exemplary flowchart, which illustrates the power management and functionality of the EAS system alarm tag shown in FIGS. 1A to 7 in accordance with the present invention.

DETAILED DESCRIPTION OF THE INVENTION

The detailed description set forth below in connection with the appended drawings is intended as a description of presently preferred embodiments of the invention and is not intended to represent the only forms in which the present invention may be constructed and or utilized.

For purposes of illustration, programs and other executable program components are illustrated herein as discrete blocks, although it is recognized that such programs and components may reside at various times in different storage components, and are executed by the data processor(s) of the computers. Further, each block within a flowchart may represent both method function(s), operation(s), or act(s) and one or more elements for performing the method function(s), operation (s), or act(s). In addition, depending upon the implementation, the corresponding one or more elements may be configured in hardware, software, firmware, or combinations thereof.

Figure 1A:
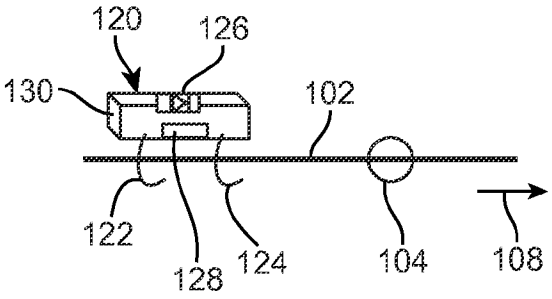
FIGS. 1A to 1C are exemplary illustrations of one or more articles displayed separately or detachably coupled and displayed together, including an EAS system alarm tag in accordance with the present invention.
Figure 1A:
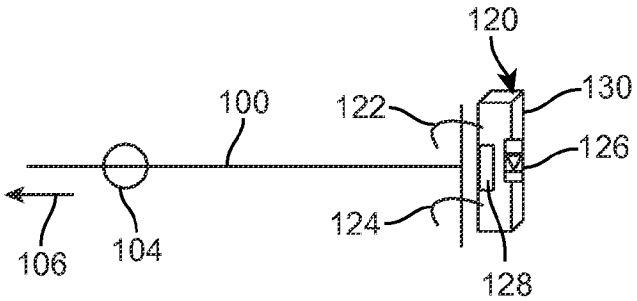
Figure 1C:
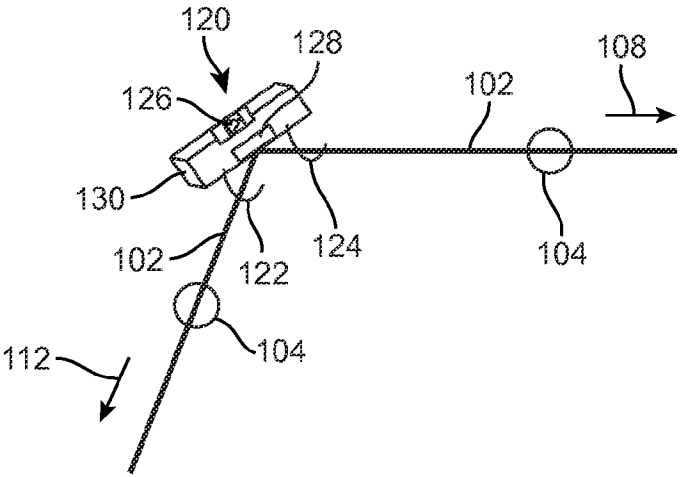
Figure 1B:
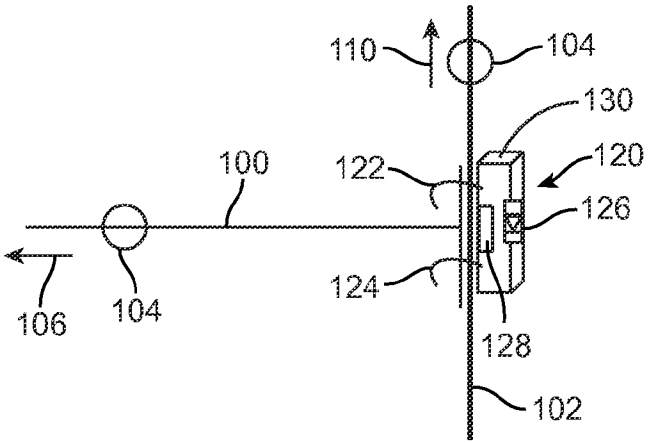

There are many instances where two are more separate articles are detachably coupled and displayed on a store shelf together. FIG. 1A is an exemplary illustration of a first article 100 and a second article 102 that may be displayed separately or as illustrated in FIG. 1B, they may be detachably coupled and displayed together. FIG. 1C represents the detachable coupling and display of two of the same article (e.g., two, second articles 102 may be detectably coupled end-to-end) together. In such instances, the use of conventional EAS tags with a single, semi-rigid strap that forms a semi-rigid loop 104 could not secure and reliably engage both of the articles simultaneously, requiring the use of two EAS tags, one for each article (FIGS. 1B and 1C). In addition, as illustrated in FIGS. 1A to 1C, even using separate conventional EAS tags with the single, semi-rigid strap loop 104 (one for each article) may not secure the articles 100 and 102 (individually (FIG. 1A) or detachably coupled (FIGS. 1B and 1C)) because the semi-rigid loop 104 of the known conventional tags themselves may be slipped off of the articles in the exemplary directions indicated by the arrows 106, 108, 110, and 112 in FIGS. 1A to 1C. Accordingly, and as further illustrated in FIGS. 1A to 1C, the present invention provides an EAS system alarm tag 120 that includes at least two straps 122 and 124 that provide a secure and reliable simultaneous engagement of one or more articles 100 and 102 to be monitored. The EAS system alarm tag 120 of the present invention may be used to secure one or more articles 100 and 102 that may be detachably coupled at any angle.

Figure 2A:
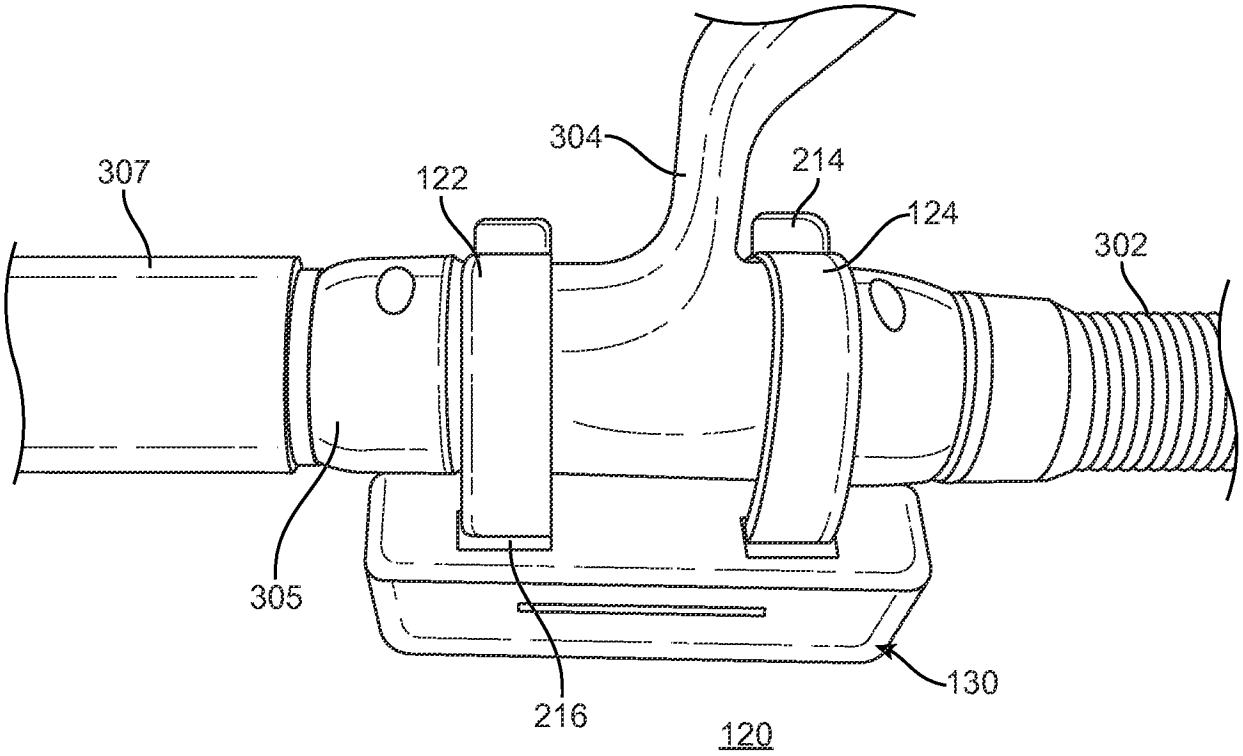
FIGS. 2A to 2C are exemplary illustrations of various views of one, non-limiting example of specific first and second articles detachably coupled and displayed together with an EAS system alarm tag in accordance with the present invention.
Figure 2B:
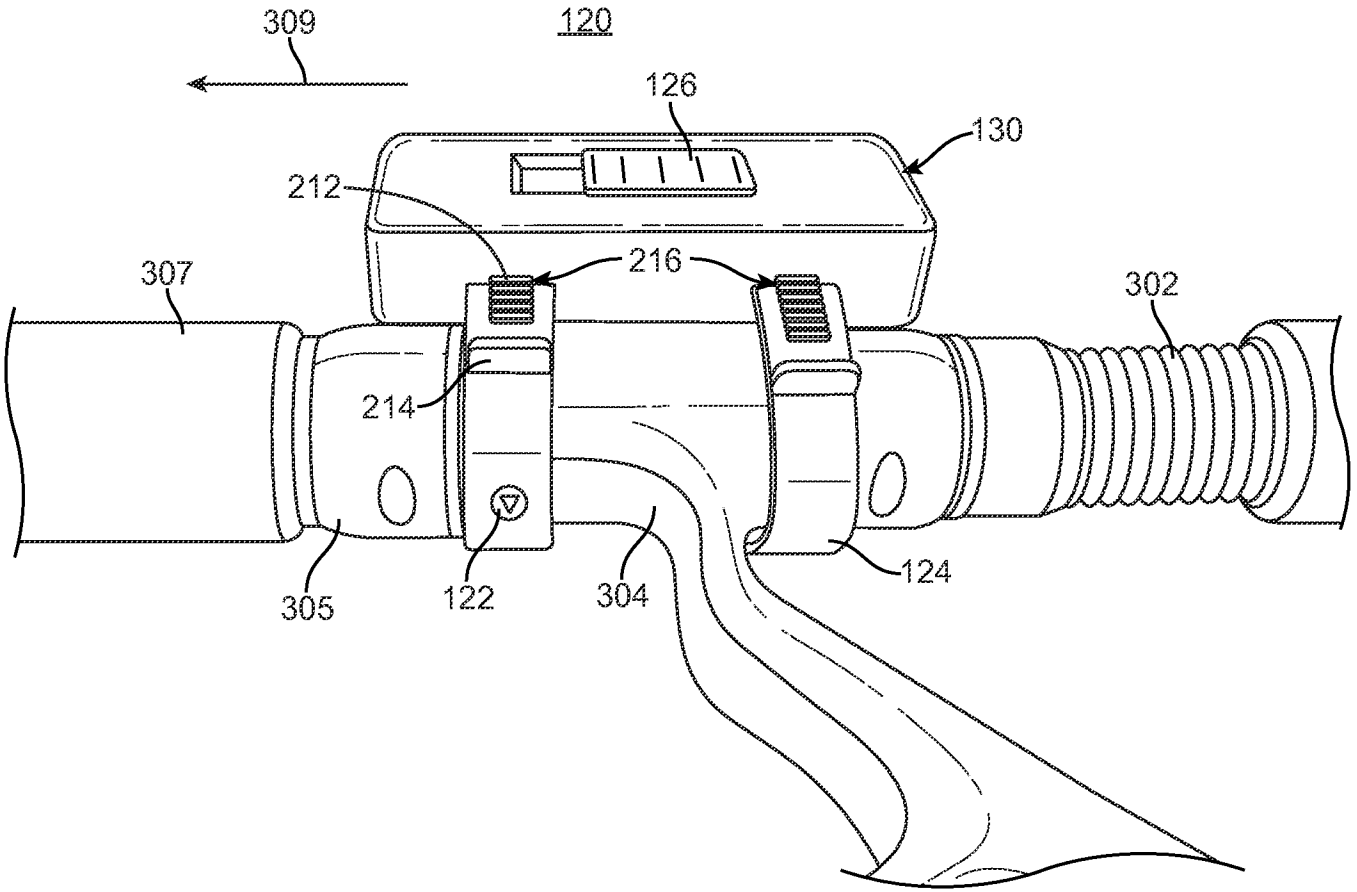
Figure 2C:
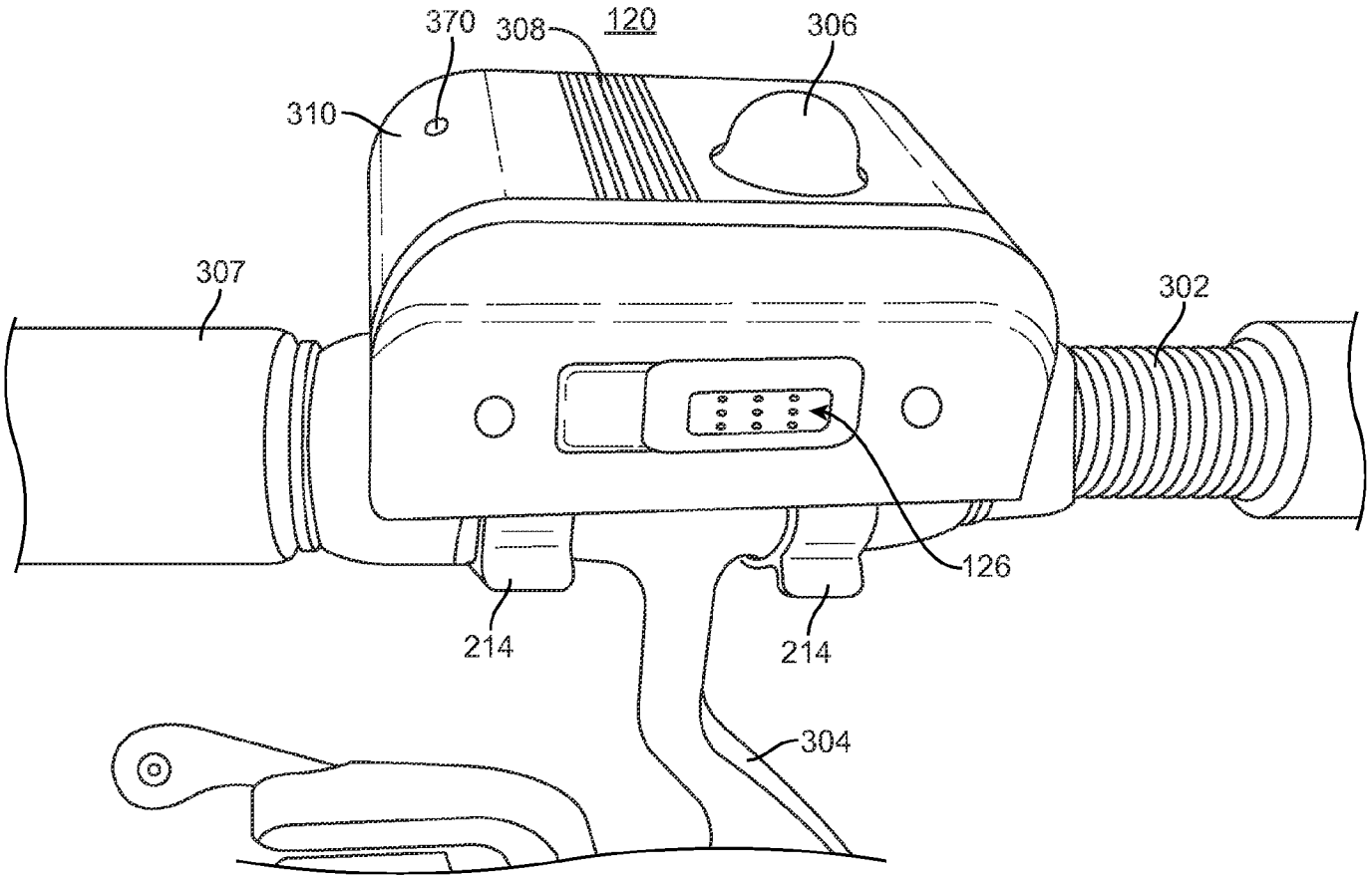

FIGS. 2A to 2C are exemplary illustrations of various views of one, non-limiting example of a first article 100 in the form of an exemplary fishing pole or rod 302, with article 102 being, by way of example only, a fishing reel 304 where in general, they are detachably coupled by fasteners 305 and displayed together on most store shelves. The EAS system alarm tag 120 of the present invention includes at least two straps 122 and 124 that securely and reliably, simultaneously engage both the fishing pole 302 and the fishing reel 304 to be monitored. That is, even if the fastener 305 is loosened to detach the handle section 307 to release the reel 304, the use of dual straps 122 and 124 with the reel 304 in between the straps will continue to securely and reliably, simultaneously engage both the fishing pole 302 and the fishing reel 304 to be monitored. The EAS system alarm tag 120 includes an interlock actuator switch 126 that enables the two or more straps 122 and 124 to interlock within a housing 130 of the alarm tag 120. In addition, the tag 120 also includes an inconspicuous auxiliary actuator switch 128 that enables detection of separation of the alarm tag 120 from one or more articles with which the alarm tag 120 is coupled. When both the interlock actuator switch 126 and the auxiliary actuator switch 128 are set to a first condition (as illustrated in FIGS. 2A to 2C), an alarm system of the alarm tag 120 is armed and set to ON. When the interlock actuator switch 126 is set to the first condition and the auxiliary actuator switch 128 is set to a second condition (e.g., open) while the alarm tag 120 is armed and ON, the alarm system of the alarm tag triggers an alarm.

Figure 3:
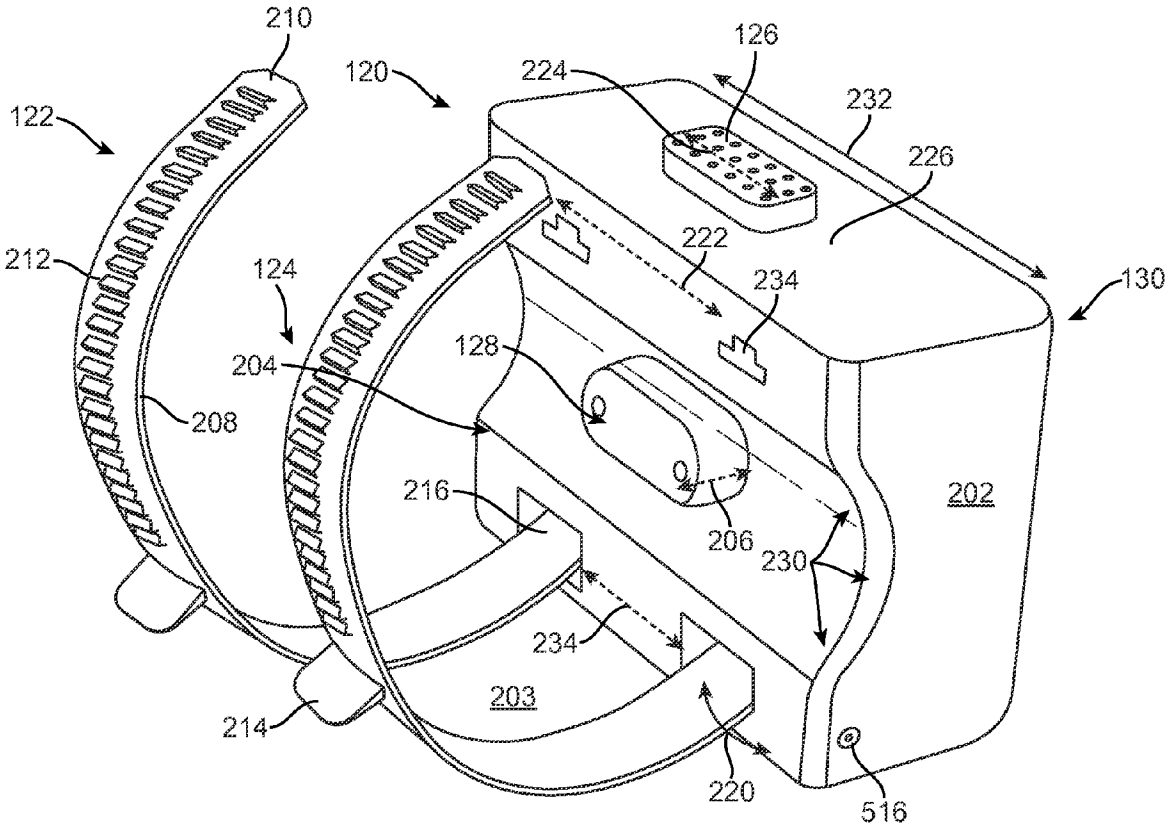
FIG. 3 is an exemplary illustration of the EAS system alarm tag of FIGS. 1A to 2C with straps open in accordance with the present invention.

FIG. 3 is an exemplary illustration of the EAS system alarm tag 120 with straps open in accordance with the present invention. As illustrated, the EAS system alarm tag 120 is comprised of a housing 130 that includes a cover section 202 and base section 204 that may be permanently coupled by various welding mechanisms. The housing 130 may be comprised of a usable rigid or hard material (e.g., might be a hard plastic), non-limiting example of which may include an injection molded Acrylonitrile Butadiene Styrene (ABS) plastic. In general, the one or more articles to be protected and monitored are placed in between the base 204 and the straps 122 and 124, while the straps are in the illustrated open position. Thereafter, the free leading edge 210 of the straps 122 and 124 is moved along path 222 and inserted within a set of interlock openings 234. The movement of the straps 122 and 124 along path 222 is enabled because the second distal ends 520 of the straps 122 and 124 are coupled with a hinge cavity 216 of the housing 130 via a hinge pin 516, enabling the straps 122 and 124 to rotate along reciprocating path 220 to be moved and inserted within the interlock openings 234.

As further illustrated, the straps 120 and 124 include a tab 214 that may be used to further insert the straps deeper into the housing 130 along the reciprocating path 222 for a tighter grip of the EAS tag 120 with the article. As more of the straps 120 and 124 are inserted into the housing 130 via the interlock openings 234, the size of the formed loop 203 (between the straps and the housing 130) decreases until articles to be monitored are tightly maintained therein. It should be noted that the housing 130 accommodates an interlock mechanism (detailed below), which engages the engaging element 212 of the straps 122 and 124 such that the insertion of the straps 122 and 124 into housing 130 in the direction 222 is allowed at any desired adjustments positions along the longitudinal axis of the straps, but extraction thereof is not allowed (unless by an authorized unlocking device). Therefore, by providing the engaging elements 212, the EAS tag 120 may engage objects of varying size by making the encircled opening or loops 203 between the straps and the housing adjustable in accordance with the locking location or position of the straps along their respective length in relation to the housing 130. Once fully inserted, the straps 122 and 124 may be interlocked with the housing by moving the interlock actuator switch 126 along reciprocating path 224 from the illustrated unlocked position (FIG. 3) to a locked position (FIGS. 2A to 2C). As the loops 203 are tightened, bodies of the articles within the loops 203 press against the inconspicuous auxiliary actuator switch 128, moving it along the reciprocating path 206. When both the interlock actuator switch 126 is set to a lock position to lock in the straps at a desired length within the housing 130, and the auxiliary actuator switch 128 is fully pressed, an alarm system of the alarm tag 120 is armed and set to ON to securely and reliably simultaneously engage one or more articles for protection and monitoring. When the interlock actuator switch 126 is set to the locked position and the auxiliary actuator switch 128 is opened while the alarm tag 120 is armed and ON, the alarm system of the alarm tag 120 triggers an alarm. An exemplary instance may be when tag 120 is manipulated to loosen the grip of the loops 203 without unlocking the interlock actuator switch 126, enabling the auxiliary actuator switch 128 to travel along path 206 to an open (protruded) position, triggering an alarm. For instance, the fishing pole handle 307 may be detached from the fishing pole 302 by unwinding the fastener 305, while manipulating tag 120 to move the reel 304 along path 309 (FIG. 2B) to slip the tag 120 off of the pole 302, which can loosen the grip of the loops 203 without unlocking the interlock actuator switch 126, enabling the auxiliary actuator switch 128 to travel along path 206 to an open (protruded) position, triggering an alarm.

Figure 4:
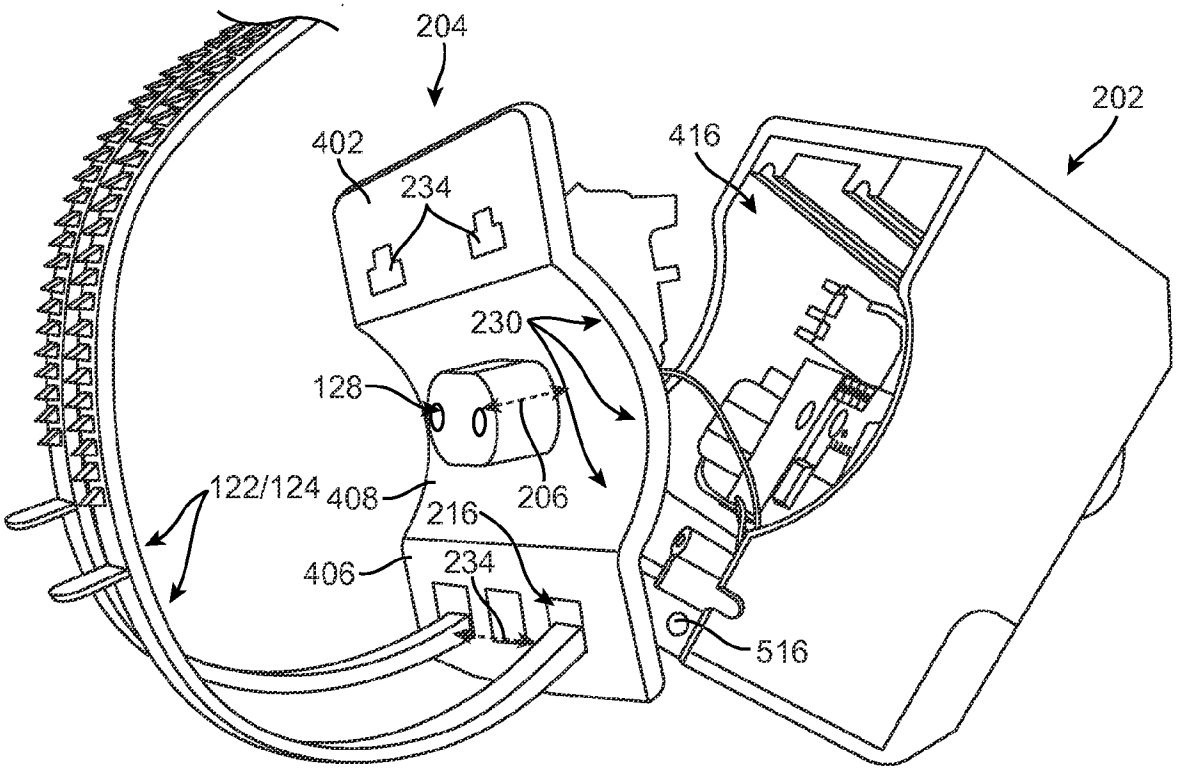
FIG. 4 is an exemplary illustration of the EAS system alarm tag shown in FIGS. 1A to 3, showing interior housing thereof in accordance with the present invention.

FIG. 4 is an exemplary illustration of the EAS system alarm tag shown in FIGS. 1A to 3, showing interior section thereof in accordance with the present invention. As illustrated, the housing 130 is comprised of a cover 202, an interior 416 of which houses most of the alarm system (including electronic components and a printed circuit board (PCB 616)) of the EAS system alarm tag 120. The housing 130 is also comprised of a base 204 having an exterior side that includes a set of interlock openings 234 at a first lateral section 402 of the base 204, along the longitudinal axis 232 of the housing that receive a first, free distal end 210 of a set of straps 122 and 124. The base 204 further includes a set of hinge cavities 216 at a second lateral section 406 of the base 204 along the longitudinal axis 232 of the housing 130 that accommodate a set of hinge mechanism 516 coupled with a second distal end 520 of the set of straps 122/124. The auxiliary switch opening 524 (FIG. 5D) defined at a mid-section 408 of the base 204 along the longitudinal axis 232 of the housing 130 accommodates the auxiliary actuator switch 128, with the mid-section 408 of the base 204 configured commensurate with a form-factor 230 of a section of one or more articles 100 and 102 with which the alarm tag 120 couples.

FIGS. 5A to 5L are exemplary illustrations of a base portion of the housing of the EAS system alarm tag shown in FIGS. 1A to 4 in accordance with the present invention. As illustrated, the base 204 has an interior side 502 that includes a set of guide flanges 506 that protrude from the interior side 502 of the first lateral section 402 of the base 204, along the longitudinal axis 232 of the housing 130 that facilitate to guide and move the first, free leading edge 210 of the straps towards interlock actuator switch 126. In addition, the interior side 502 also includes an auxiliary actuator switch housing 510 that accommodates the auxiliary actuator switch 128 and an auxiliary switch 528 (with the auxiliary switch arm 512 illustrated through an actuator opening 544). The second lateral section 406 of the interior side 502 of the base 204 including a hinge mechanism 508 (one per strap). As illustrated in FIGS. 5A and 5B, the hinge mechanism 508 includes the hinge cavity 216 that accommodates the second distal end 520 of the strap 122 and 124, and a hinge chamber 518 that accommodates hinge pin 516. The hinge chamber 518 is defined by walls 511 along the three sides thereof, and the rounded cavity 216 at top (in the form of a tunnel). As illustrated best in FIG. 5B, the second distal end 520 of the strap is first positioned within the hinge cavity 216, and the hinge pin 516 is then inserted through the open end 509 of the hinge chamber 518 and the through hole 521 of the second distal end 520 of the strap to pivotally couple the strap to the housing 130.

As best illustrated in FIG. 5C, a strap of the present invention is comprised of a first, free leading edge 210, and a second distal end 520 that includes the through hole 521 to enable the strap to pivotally couple with the tag 120 of the housing 130. The straps further include a first surface 501 that includes engaging elements 212 forming serrations that engage with an interlock clip 610 of the interlock actuator switcher 126 such that insertion of the strap into the housing in a first direction is allowed at any desired adjustments along a longitudinal axis of the strap, but extraction thereof is not allowed, thereby by enabling the EAS alarm tag to engage objects of varying sizes. As further illustrated, the straps also include a tab 214 that is projected from the first surface 501, oriented transverse a longitudinal axis of the strap. The tab 214 may be used to facilitate in further insertion of the strap deeper into the housing 130 along a reciprocating path 222 for a tighter grip of the loop 203 of the straps of the EAS tag 120 onto the article. The straps also may optionally have a reinforcement piece 522 that is inserted along a length of the straps. Inserted reinforcement piece 522 may be an elongated metal that adds strength to straps and makes straps more difficult to defeat by cutting. As best illustrated in FIGS. 2A to 2C, the leading edge 210 of the straps is inserted into an interlock opening 234 of the housing 130, thereby enclosing the loop 203 in a compact form. The straps are generally made of a flexible, yet durable and strong material, for example plastic or hardened rubber.

FIG. 5D is an exemplary illustration of the interior facing side 502 of the base 204 with the auxiliary actuator switch housing 510 removed, exposing the auxiliary switch 528 and its switch arm 512, which is housed within the auxiliary switch housing 531. The base 204 includes an auxiliary actuator switch hole 524 that accommodates the body of the auxiliary actuator switch 128, which protrudes out from the hole 524. As the auxiliary actuator switch 128 is moved along path 206, it contacts the switch arm 512 of the auxiliary switch 528 to close the switch 528 and set the alarm system of the alarm tag 120.

FIGS. 5E to 5I are exemplary illustrations of the various views of the auxiliary actuator switch housing. As illustrated, the auxiliary actuator switch housing 510 is comprised of a set of fastening holes 532 that are aligned with the fastener apertures 526 (FIG. 5D) on the interior side 502 of the base 204 to enable use of a set of fasteners 514 for coupling of the auxiliary actuator switch housing 510 with the interior side 502 of the base 204. Further included is an actuator opening 544 that enables an actuator arm 552 of the auxiliary actuator switch 128 to move out through the actuator opening 544 while pressing onto the switch arm 512 of the auxiliary switch 528. The auxiliary actuator switch housing 510 also includes actuator guides 546 that guide a set of support guides 550 of the auxiliary actuator switch 128 along a reciprocating path 206. The auxiliary actuator switch housing 510 also includes an auxiliary switch cover 530 that encloses the auxiliary switch housing 531 to secure the auxiliary switch 528 in position. Further included is a pair of blocking flanges 536 that contact the respective projections 558 of the auxiliary actuator switch 128 to moveably secure and couple the switch 128 with the auxiliary actuator switch housing 510.

As best illustrated in FIGS. 5E to 5G, and 5J to 5K, the auxiliary actuator switch 128 includes a biasing mechanism housing 560 protruded from a mid-section of an interior bottom of the auxiliary actuator switch 128 for accommodating a first distal end of a biasing mechanism 540. The second distal end of the biasing mechanism 540 is supported by the biasing support protrusion 542 (FIG. 5H) of the auxiliary actuator switch housing 510 (FIGS. 5J and 5G). The switch 128 also includes support guides 550 protruding from substantially distal portions of the interior bottom of the auxiliary actuator switch 128 for facilitating move of the auxiliary actuator switch 128 along the reciprocating path 206 while the support guides 550 move through actuator guides 546. Also included is an actuator arm 552 comprised of one or more curved sloping flanges 554 that protrude from a periphery edge 513 of the auxiliary actuator switch 128, along a length thereof, and spaced apart 556, enabling the actuator arm 552 to slide onto a switch arm 512 of the auxiliary switch 528 to actuate the auxiliary switch 528 as the auxiliary actuator switch 128 is fully pressed by an article.

FIGS. 1A to 4, and 6A to 6H are exemplary illustrations of the cover portion of the housing of the EAS system alarm tag shown in FIGS. 1A to 5L in accordance with the present invention. As illustrated in FIGS. 1 to 4, the cover 202 has an exterior side that includes a first aperture 226 for accommodating the interlock actuator switch 126, a second aperture 310 for accommodating a visual indicator 370, a protuberance 306 for housing an interlock clutch 659, and a perforated area 308 that forms grill-openings for output of an audio indicator sound.

As illustrated in FIGS. 6A to 6H, the cover 202 has an interior section 416 that accommodates the interlock actuator switch 126 and the alarm system of the EAS system alarm tag 120. The interlock actuator switch 126 is comprised of top section 609 (FIG. 6D) with a top surface that has a handle 607 (FIG. 6F) that protrudes out of the first aperture 226. Underneath the top section 609 of the interlock actuator switch 126 (the side 602 of the switch) includes clip housing portions 608 that accommodate clips 610, the tips 612 of which interlock with the engaging elements 212 of the straps (best illustrated in FIG. 6C) when the straps are fully inserted into the housing 130 and through the opening 614, and the interlock actuator switch 126 is moved along path 224 to a locking position. Walls 620 define the openings 614, which receive the straps 122 and 124. The elements 620 provide structural integrity to the housing 130 in terms of added strength and, additionally, due in part to their curved edges, guide the tip 210 of the straps downward to allow further insertion of the straps into the housing 130.

FIG. 6A exemplarily illustrates the interlock actuator switch 126 in open (unlocked) position (indicated by the space 604 to the left of the switch 126) and FIG. 6B exemplarily illustrates the interlock actuator switch 126 in closed (locked) position (indicated by the space 604 to the right of the switch 126). At the closed, locked position, a locking protrusion 640 at side 615 (FIG. 6E) of the switch 126 is associated with a locking clutch 659 for locking the interlock actuator switching 126 to the indicated locked position. At this locked position, an indentation 632 for accommodating a switch arm 680 of a switch 672 is moved away from the switch 672, wherein as the interlock actuator switch 126 is moved from an unlock to a lock position, a lower beveled edge 634 progressively presses the switch arm 680 until a bottom edge 636 reaches and fully presses the switch arm 680 to activate the switch 672, with the interlock actuator switch 126 locked in position by the associated locking clutch 659 blocked by the locking protrusion 640. The locking protrusion 640 has a height 646, a depth 648 and a sloping length 650 at an angle β. The indentation 632 is extended 654 from the side 615 of the interlock actuator switch 126. As best illustrated in FIGS. 6G and 6H, the interlock clutch 659 is comprised of resilient member 662 that moves in the direction indicated by the reciprocating path 617 to move the engaging tip 660, whereby the engaging tip 660 is moved and pushed inward away from the side 615 by the sloping section of the protrusion 640, and extends and snaps out and locks at the back surface 642 of the interlock protrusion 640 by the biasing mechanism 664.

FIG. 7 is an exemplary schematic illustration of the alarm system of the present invention. The alarm system is comprised of a microprocessor 703 with pins 1 and 14 of the microprocessor 703 respectively coupled to Vcc and ground GND via a filter capacitor 726, which power the microprocessor 703. The power is supplied by the power connector 718 and provided as the power Vcc to the circuit by the power source 676. As further illustrated, the alarm tag 120 includes a plurality of independent mechanical and electrical circuitry that function to protect one or more articles with which the alarm tag 120 is coupled for protection. A first input unit in an exemplary form of the interlock actuator switch 126 that has associated with it a first independent mechanical and electrical circuitry that enables a trigger of an alarm in case of tampering. A second input unit in the form of the exemplary auxiliary actuator switch 128 has associated with it a second independent mechanical and electrical circuitry that sets (or arms) the alarm tag and triggers an alarm in case of tampering. Finally, a third input unit in the exemplary form of the EAS tag 618 (such as a ferrite) that has associated with it a third independent mechanical and electrical circuitry (e.g., connector 702, and the amplifier 710) that receives or sends signals, and triggers an alarm in case of an unauthorized removal of an article from a secure surveillance zone.

In FIG. 7, the dashed line indicated as reference 780 generally represents the interlock actuator switch 126 and the auxiliary actuator switch 128 and their respective interconnections (via the respective switches 672 and 528) with the alarm device. As illustrated in FIG. 7, to activate (or arm) the alarm tag 120 (after the insertion of the straps within the housing 130), the interlock actuator switch 126 is moved along path 224, which actuates and closes the interlock switch 672, and as a result, the coupled Vcc is pulled to ground GND via the current limiting resistor 760. The auxiliary switch 528 closes when in contact with one or more articles as described above, and when it closes, the coupled Vcc is pulled to ground GND via its current limiting resistor 762. When both switches 672 and 528 close, the respective lines 714 and 758 coupled with the input pins 6 and 7 of the processor 703 are pulled low and set to "0" activation (or arming) of the alarm device of the alarm tag 120. Accordingly, when fully closed, the switches 528 and 672 enable supply of power from the power source 718 to the alarm system, and the output of the switches pulled low and set to "0" instruct the microprocessor 703 to arm the alarm.

As further illustrated, the alarm system further includes the general purpose microprocessor 703 mounted onto a PCB 616 with an internal memory (e.g., an EEPROM) that includes a set of instructions. The microprocessor 703 receives one or more input signals from one or more input periphery devices and generates one or more processed output signals for actuation of one or more periphery output devices. The processing of data may include Analog to Digital (A/D) or D/A conversion of signals, and further, each input or pin of the microprocessor 703 may be coupled with various multiplexers to enable processing of several multiple input signals from different input periphery devices with similar processing requirements. Non-limiting examples of one or more input periphery devices may exemplarily include the interlock actuator switch 126, the auxiliary actuator switch 128, and the EAS tag 618. Non-limiting examples of one or more output periphery devices may exemplarily include the use of vibration mechanisms, audio, visual or any other indicators to alarm and notify a user regarding an occurrence.

As exemplarily illustrated in FIG. 7, the alarm tag 120 may use a first input periphery device in the form of the electronic article surveillance (EAS) tag 618 coupled with an EAS connector 702, with the EAS tag 618 comprised of a ferrite unit. As illustrated, a first output of the EAS connector 702 is coupled with ground, and a second output of the EAS connector 702 is coupled with an amplifier 710 to generate an amplified signal from the EAS tag 618. The amplifier 710 increases the signal strength from the EAS tag 618 sufficiently for further processing by the alarming circuit. The amplifier 710 is comprised of a current limiting resistor 704 that limits the current input to the base of the transistor 706, with the transistor 706 functioning to amplify the signal from EAS connector 702. The transistor 706 is comprised of an exemplary NPN Bipolar Junction Transistor (BJT), with the collector coupled to power supply Vcc and the emitter coupled to ground via a resistor-capacitor filter. It should be noted that the present invention should not be considered limited to the amplifier 710 illustrated, and other conventional amplifiers may also be used. Further, the amplification need not be performed by the BJT, but can be done by other transistors, such as Metal Oxide Semiconductors (MOS) or MOS field effect transistors (MOSFETS), operational amplifiers, transformers, or the like, other passive or active devices, or any combination thereof.

The output of the EAS tag is amplified by the amplifier 710, and the amplified signal (form the emitter of the transistor 706) is input to the microprocessor 703 via the input line 716 as one of one or more input signals, where the microprocessor 703 converts the analog amplified signal into a digital signal for processing. This signal is translated by the instructions (algorithm) within the EEPROM of the microprocessor 703 to determine if the signal came from the transmitters (pedestals); if so, the microprocessor 703 will trigger the alarm (e.g., an audio and/or visual indicator). It should be noted that one or more of the one or more processed output signals may be pulsed output signals on output line 710 to one of the one or more periphery output devices, for example, for actuation of a transducer unit 740 to generate an audio alarm signal.

The transducer unit 740 (shown as the audio output 674 in FIG. 6H) is actuated by an amplified pulsed output signal that is output from the microprocessor 703 via line 709, and further amplified by an output amplifier 752. The output amplifier 752 is comprised of a BJT transistor 750 with an emitter coupled to ground, a collector coupled to a transformer 748 of the transducer 740, and a base that is coupled with a current limiting resistor. The transistor 750 amplifies the pulsed output signal from line 710 to alternately drive the transformer from high Vcc to ground and vice versa, with the transformed pulse driving a ceramic transducer 742 to generate an audible alarm. It should be noted that a software routine within the microprocessor generates this pulsed output, which is amplified by the transistor 750. In addition to the generation of an audible alarm, as further illustrated, other output periphery devices may include the uses of a visual indicator 746 that use LEDs 370 to notify users of an occurrence. The visual indicator 746 is coupled with line 790 of the microprocessor 703. As indicated above, other output periphery devices not illustrated may also easily be accommodated and connected with the microprocessor 703.

As further illustrated, pins 1 and 14 of the microprocessor 703 are respectively coupled to Vcc and ground via a filter capacitor, which power the microprocessor 703. The power is supplied to the power connector 718. The microprocessor 703 is further coupled via its pin 2 to ground through another filter capacitor 712. The crystal 730 coupled to pin 13 is used to facilitate a clocking signal to the microprocessor 703. That is, it stabilizes the frequency of the clock in the microprocessor 703. Pins 10 and 11 are respectively for reset and test of the microprocessor 703, which is through a connector 754 that enables the testing and reset of the microprocessor 703. The testing and reset enable determination of signaling of the microprocessor 703, for example, to determine if the microprocessor 703 functions based on "0" or "1" input signal level to trigger a device. In this exemplary instance, the microprocessor 703 will trigger an output periphery device when the input is pulled to high (or "1"). For example, when the auxiliary actuator switch 128 (or 528) is opened, pulling the line 758 to Vcc (high or "1"), which triggers an alarm. The reset pin 10 is coupled with the reset circuit 732, which includes a current limiting resistor 734 that is coupled at one end to Vcc and other end to a capacitor 736, with the other end of the capacitor 736 coupled to ground. The reset pin 10 is coupled with at the junction of the resistor 734 and capacitor 736.

FIG. 8 is an exemplary flowchart, which illustrates the power management and functionality of the microprocessor 703 for the alarm tag 120. As illustrated, upon start of the program at the operational act 802, the microprocessor 703 initializes at the operational act 804. At the next operational act 806 the microprocessor 703 determines if the switches 126 and 128 are closed. If at the operational act 806 it is determined that the switches 126 and 128 are not closed, the microprocessor 703, at operational act 810, outputs a low power mode operational signal (e.g., sleep mode), with the operation reverting to initialization at operational act 804. If the microprocessor 703 determines that the switches 126 and 128 are closed, then at the operational act 812 the microprocessor 703 determiners if supplied power is greater than a first threshold level. If at the operational act 812 it is determined that supplied power is not greater than a first threshold level, the device becomes non-functional. Otherwise, if at the operational act 812 the microprocessor 703 determines that supplied power is greater than the first threshold, the microprocessor 703, at the operational act 816, determines if the supplied power is greater than a second threshold level, with the second threshold level being greater than the first threshold level. If the microprocessor 703 determines that the supplied power is not greater than a second threshold level, the microprocessor 703 at the operational act 818 activates various output periphery units in a predetermined manner to indicate low supply of power, but continues and arms the alarm tag 120 to protect an article. If the microprocessor 703 determines that the supplied power is greater than the second threshold level, the alarm tag is set (or armed) after a predetermined time at the operational functional act 820, and various indicators are activated to indicate to users that the article is protected.

To continue with the flowchart of FIG. 8, the microprocessor 703 at the operational act 822 determines if an antenna signal is received from associated EAS equipment. If the microprocessor 703 determines that an antenna signal is received, at the operational act 824, the microprocessor 703 activates an alarm. A non-limiting example for such an alarm incident (or condition) is the actual removal of the article with which the alarm tag 120 is coupled from a store, passing them through a surveillance zone. This will activate the EAS tag unit 618 to trigger a signal, which will be amplified and input to the microprocessor 703 to activate (or trigger) the alarm. Further, at the operational act 801 the microprocessor 703 determines if the interlock actuator switch 126 is unlocked (or open). A non-limiting exemplary reason for checking to determine if the switch 126 is open at the operational act 801 after an alarm incident (at the operational act 824) is that, may be an actual authorized person is in the process of properly disarming the alarm tag 120 after an alarm incident at the operational act 824. That is, the alarm tag 120 and the article with which the tag 120 is coupled are brought to an authorized store personal to be properly disarmed. If at the operational act 801 it is determined that, the switch 126 is not open, at the operational act 824 the alarm is continuously activated. In other words, the alarm tag 120 has still not been disarmed.

Referring back to the operational act 822, if the microprocessor 703 determines that no antenna signal was received at the operational act 822, the microprocessor 703, at the operational act 840 determines if the switch 128 is open. If the microprocessor 703 determines that the switch 128 is open and at operational act 801 it determines that the switch 126 is not open, then at operation act 824 the alarm is activated. Otherwise, at the operational act 840 if the microprocessor 703 determines that the switch 128 is closed, then at the operational act 842, it determines if switch 126 is opened. If at operational act 842 the microprocessor 703 determines that the switch 126 is open, the entire unit initializes at operational act 804. On the other hand, if the microprocessor 703 determines that the switch 126 is closed (that is, both switch 128 and 126 are determined to be closed in the respective operational acts 840 and 842), then at operational act 830 a determination is made regarding a timer to determine if a predetermined time has been reached. If at operational act 830 it is determined that a predetermined time has elapsed, an indicator is output at functional act 832 and the timer is reset at operational act 834, where the microprocessor 703 then repeats operational act 822, which is to determine if an antenna signal has been received. The operation of the output indicator at functional act 832 is an audio, visual, or vibration indicator that enables a user to determine if the tag 120 is properly armed. The microprocessor 703 output a visual and/or audio indicator periodically (while the tag 120 is armed) at specified predetermined time intervals T.

Although the invention has been described in considerable detail in language specific to structural features and or method acts, it is to be understood that the invention defined in the appended claims is not necessarily limited to the specific features or acts described. Rather, the specific features and acts are disclosed as preferred forms of implementing the claimed invention. Stated otherwise, it is to be understood that the phraseology and terminology employed herein, as well as the abstract, are for the purpose of description and should not be regarded as limiting. Therefore, while exemplary illustrative embodiments of the invention have been described, numerous variations and alternative embodiments will occur to those skilled in the art. For example, the single interlock actuator switch 126 may be replaced by a multiplicity thereof where each enables a corresponding strap to interlock within a housing of the alarm tag, and each actuates to a first condition so to (independently or together) set the alarm of the alarm tag to ON. As another example, the single auxiliary actuator switch 128 switch may be replaced by a multiplicity thereof, and positioned along any section of the housing base 204, with each (independently or together) enabling detection of separation of the alarm tag from one or more articles with which the alarm tag is coupled. The form factor or shape of the housing 130 may be varied and should not be limited to the illustrated substantially rectangular box. For example, the housing 130 might be configured as an inverse V-shape with two independent auxiliary actuator switches 128 positioned within the distal edges of the interior walls of the inverse V-shaped tag. As yet another example, the separation distance 234 between the straps may be varied. Such variations and alternate embodiments are contemplated, and can be made without departing from the spirit and scope of the invention.

It should further be noted that throughout the entire disclosure, the labels such as left, right, front, back, top, bottom, forward, reverse, clockwise, counter clockwise, up, down, or other similar terms such as upper, lower, aft, fore, vertical, horizontal, oblique, proximal, distal, parallel, perpendicular, transverse, longitudinal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) is not used to show a serial or numerical limitation but instead is used to distinguish or identify the various members of the group.

In addition, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of," "act of," "operation of," or "operational act of" in the claims herein is not intended to invoke the provisions of 35 U.S.C. 112, Paragraph 6.

What is claimed is:

1. An alarm tag, comprising:

two or more straps that enable secure engagement of the alarm tag with articles;

an interlock actuator switch that enables the two or more straps to interlock within a housing of the alarm tag; and an auxiliary actuator switch that enables detection of separation of the alarm tag from the articles with which the alarm tag is coupled;

wherein when the interlock actuator switch is closed and the auxiliary actuator switch is closed, an alarm system of the alarm tag is armed; and wherein when the interlock actuator switch is closed but the auxiliary actuator switch is opened while the alarm tag is armed, the alarm system of the alarm tag triggers an alarm.

2. The alarm tag as set forth in claim 1, wherein:

the housing is comprised of:

a base having an exterior side that includes:

a set of interlock openings at a first lateral section of the base, along the longitudinal axis of the housing that receive a first, free distal end of the two or more straps;

a set of hinge cavities at a second lateral section of the base along the longitudinal axis of the housing that accommodate a set of hinge mechanisms coupled with a second distal end of the two or more straps;

an auxiliary switch opening defined at a mid-section of the base along the longitudinal axis of the housing that accommodates the auxiliary actuator switch, with the mid-section of the base configured commensurate with a shape of a section of one or more articles with which the alarm tag couples.

3. The alarm tag as set forth in claim 2, wherein:

the base has an interior side that includes:

a set of guide flanges that protrude from the interior side of the first lateral section of the base, along the longitudinal axis of the housing that guide the first, free leading edge of the straps towards the interlock actuator switch; and an auxiliary actuator switch housing that accommodates the auxiliary actuator switch and an auxiliary switch.

4. The alarm tag as set forth in claim 3, wherein:

the auxiliary actuator switch housing is coupled with the interior side of a mid-section of the base;

the auxiliary actuator switch housing is comprised of:

a set of fastening holes that enable use of a set of fasteners for coupling of the auxiliary actuator switch housing with the interior side of the base;

a first actuator opening that enables an actuator arm of the auxiliary actuator switch to move out of the first actuator opening while pressing a switch arm of an auxiliary switch;

actuator guides that guide a set of support guides of the auxiliary actuator switch along a reciprocating path;

an auxiliary switch cover that encloses an auxiliary switch housing; and a pair of blocking flanges that secure the auxiliary actuator switch.

5. The alarm tag as set forth in claim 4, wherein:

the auxiliary actuator switch includes a biasing mechanism housing protruded from a mid-section of an interior bottom surface of the auxiliary actuator switch housing for accommodating a biasing mechanism;

support guides protruding from substantially distal portions of the interior bottom surface of the auxiliary actuator switch housing for facilitating movement of the auxiliary actuator switch along the reciprocating path while the support guides move through actuator guides;

an actuator arm comprised of one or more curved sloping flanges that are spaced apart and protrude from a periphery edge of the auxiliary actuator switch housing, along a length thereof, enabling the actuator arm to slide over a switch arm of an auxiliary switch to actuate the auxiliary switch as the auxiliary actuator switch is fully pressed by the articles.

6. The alarm tag as set forth in claim 1, wherein:

the housing is further comprised of:

a cover that includes:

a first aperture for accommodating the interlock actuator switch;

a second aperture for accommodating a visual indicator;

a protuberance for housing an interlock clutch; and a perforated area that forms grill-openings for output of an audio indicator sound.

7. The alarm tag as set forth in claim 6, wherein:

the cover accommodates the interlock actuator switch and the alarm system of the alarm tag, the interlock actuator switch comprises:

a clip at a top portion thereof;

an opening defined by walls for receiving one of the two or more straps;

a locking protrusion associated with the interlock clutch for locking the interlock actuator switch to a locked position; and an indentation for accommodating a switch arm of an alarm switch that sets an alarm;

wherein as the interlock actuator switch is moved from an unlock to a lock position, a lower beveled edge of the interlock actuator switch progressively presses the switch arm until a bottom edge of the interlock actuator switch reaches and fully presses the switch arm to activate the alarm switch, with the interlock actuator switch locked in position by the associated interlock clutch being blocked by the locking protrusion.

8. The alarm tag as set forth in claim 1, wherein:

a strap of the two or more straps is comprised of:

the first, free leading edge;

the second distal end of the strap is accommodated within a set of hinge cavities at a second lateral section of the base along the longitudinal axis of the housing, and is coupled with a hinge mechanism in a form of a hinge pin;

the hinge pin is inserted within a hole of the second distal end of the strap, with the second distal end of the strap and the hinge pin secured within a hinge chamber;

a first surface that includes engaging elements comprised of serrations that engage with an interlock clip of the interlock actuator switch such that insertion of the strap into the housing in a first direction is allowed, but extraction thereof is not allowed, thereby enabling the alarm tag to engage the articles; and a tab that is projected from the first surface, oriented transverse a longitudinal axis of the strap.

9. The alarm tag as set forth in claim 1, wherein:

the alarm system includes an Electronic Article Surveillance (EAS) tag.

10. An alarm tag, comprising:

two or more straps that enable secure engagement of the alarm tag with articles;

an interlock actuator switch that enables the two or more straps to interlock within a housing of the alarm tag; and an auxiliary actuator switch that enables detection of separation of the alarm tag from the articles with which the alarm tag is coupled;

wherein when the interlock actuator switch is closed and the auxiliary actuator switch is closed, an alarm system of the alarm tag is armed; and wherein when the interlock actuator switch is closed but the auxiliary actuator switch is opened while the alarm tag is armed, the alarm system of the alarm tag triggers an alarm;

the alarm system includes:

an Electronic Article Surveillance (EAS) tag that is comprised of a ferrite unit; and a microprocessor that is associated with the EAS tag, the interlock actuator switch, and the auxiliary actuator switch.

11. The alarm tag as set forth in claim 10, wherein:

the interlock actuator switch actuates a first switch to one of a closed and an open position; and the auxiliary actuator switch actuates a second switch to one of a closed and an open position, with the first and second switches coupled with the microprocessor.

12. The alarm tag as set forth in claim 10, wherein:

the housing includes an opening for accommodating the interlock actuator switch.

13. The alarm tag as set forth in claim 10, wherein:

the housing includes an opening for accommodating the auxiliary actuator switch.

14. The alarm tag as set forth in claim 10, wherein:

a strap of the two or more straps includes engaging elements that allow one-direction insertion of the strap into the housing.

15. An alarm tag, comprising:

two or more straps that enable secure engagement of the alarm tag with articles;

an interlock actuator switch that enables the two or more straps to interlock within a housing of the alarm tag;

an auxiliary actuator switch that enables detection of separation of the alarm tag from the articles with which the alarm tag is coupled; and an alarm system that includes:

a microprocessor that is associated with:

an Electronic Article Surveillance (EAS) tag that is comprised of a ferrite unit;

a first switch that is opened and closed by the interlock actuator switch; and a second switch that is opened and closed by the auxiliary actuator switch;

wherein closure of the first and second switches by the respective interlock actuator switch and the auxiliary actuator switch enables the microprocessor to arm the alarm system of the alarm tag.

16. The alarm tag as set forth in claim 15, wherein:

an alarm of the alarm system of the alarm tag is triggered by the microprocessor when the first switch is closed but the second switch is opened while the alarm tag is armed.

17. The alarm tag as set forth in claim 15, wherein:

the housing includes an opening for accommodating the interlock actuator switch.

18. The alarm tag as set forth in claim 15, wherein:

the housing includes an opening for accommodating the auxiliary actuator switch.

19. The alarm tag as set forth in claim 15, wherein:

a strap of the two or more straps includes engaging elements that allow one-direction insertion of the strap into the housing.

* * * * *